US009399993B2

(12) United States Patent
Sekiya et al.

(10) Patent No.: US 9,399,993 B2
(45) Date of Patent: Jul. 26, 2016

(54) VANE COMPRESSOR HAVING A VANE SUPPORTER THAT SUPPRESSES LEAKAGE OF REFRIGERANT

(75) Inventors: Shin Sekiya, Chiyoda-ku (JP); Raito Kawamura, Chiyoda-ku (JP); Hideaki Maeyama, Chiyoda-ku (JP); Shinichi Takahashi, Chiyoda-ku (JP); Tatsuya Sasaki, Chiyoda-ku (JP); Kanichiro Sugiura, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 110 days.

(21) Appl. No.: 14/350,998

(22) PCT Filed: Jan. 11, 2012

(86) PCT No.: PCT/JP2012/000113

§ 371 (c)(1), (2), (4) Date: Apr. 10, 2014

(87) PCT Pub. No.: WO2013/105130

PCT Pub. Date: Jul. 18, 2013

(65) Prior Publication Data

US 2014/0271315 A1 Sep. 18, 2014

(51) Int. Cl.
*F03C 2/00* (2006.01)
*F03C 4/00* (2006.01)
(Continued)

(52) U.S. Cl.
CPC ..... *F04C 18/3441* (2013.01); *F01C 21/0836* (2013.01); *F04C 18/321* (2013.01);
(Continued)

(58) Field of Classification Search
CPC ..... F04C 2/344; F04C 2/3446; F04C 18/321; F04C 18/344; F04C 18/3441; F04C 18/352; F04C 29/02; F04C 29/023; F04C 29/025; F04C 29/12; F04C 2240/63; F04C 2240/809; F04C 2240/603; F01C 21/0809; F01C 21/0818; F01C 21/0836
USPC ..... 418/82, 88, 93, 94, 136, 137, 145, 148, 418/241, 259
See application file for complete search history.

(56) References Cited

U.S. PATENT DOCUMENTS 1,291,618 A 1/1919 Olson
1,339,723 A 5/1920 Smith
(Continued)

FOREIGN PATENT DOCUMENTS

CH 181039 A 11/1935
CN 103080553 A 5/2013
(Continued)

OTHER PUBLICATIONS

Extended European Search Report issued Jun. 19, 2015 in Patent Application No. 12865159.3.
(Continued)

*Primary Examiner* — Theresa Trieu
(74) *Attorney, Agent, or Firm* — Oblon, McClelland, Maier & Neustadt, L.L.P.

(57) ABSTRACT

To allow a bush to stably rotate about a bush center, an end of a vane portion that is close to an inner circumferential surface center is always positioned on the inner side with respect to the bush center. Thereby, in a vane compressor a vane is stably supported, wear at a tip of the vane is suppressed, loss due to sliding on bearings is reduced by supporting a rotating shaft portion with a small diameter, and accuracy in outside diameter and center of rotation of a rotor portion is increased.

7 Claims, 16 Drawing Sheets

(51) Int. Cl.

| | |
|---|---|
| ***F04C 2/00*** | (2006.01) |
| ***F04C 18/344*** | (2006.01) |
| ***F04C 18/352*** | (2006.01) |
| ***F01C 21/08*** | (2006.01) |
| ***F04C 18/32*** | (2006.01) |
| ***F04C 29/02*** | (2006.01) |
| *F04C 23/00* | (2006.01) |

(52) U.S. Cl.
CPC ..... *F04C18/352* (2013.01); *F04C 29/025* (2013.01); *F04C 23/008* (2013.01); *F04C 2240/603* (2013.01); *F04C 2240/809* (2013.01)

(56) References Cited

U.S. PATENT DOCUMENTS

| | | | |
|---|---|---|---|
| 1,444,269 | A | 2/1923 | Piatt |
| 2,044,873 | A | 6/1936 | Beust |
| 4,955,985 | A | 9/1990 | Sakamaki et al. |
| 4,958,995 | A | 9/1990 | Sakamaki et al. |
| 4,997,351 | A | 3/1991 | Sakamaki et al. |
| 4,997,353 | A | 3/1991 | Sakamaki et al. |
| 4,998,867 | A | 3/1991 | Sakamaki et al. |
| 4,998,868 | A | 3/1991 | Sakamaki et al. |
| 5,002,473 | A | 3/1991 | Sakamaki et al. |
| 5,011,390 | A | 4/1991 | Sakamaki et al. |
| 5,022,842 | A | 6/1991 | Sakamari et al. |
| 5,030,074 | A | 7/1991 | Sakamaki et al. |
| 5,032,070 | A | 7/1991 | Sakamaki et al. |
| 5,033,946 | A | 7/1991 | Sakamaki et al. |
| 5,044,910 | A | 9/1991 | Sakamaki et al. |
| 5,087,183 | A | 2/1992 | Edwards |
| 5,242,280 | A | 9/1993 | Fujio |
| 5,536,153 | A | 7/1996 | Edwards |
| 6,193,906 | B1 | 2/2001 | Kaneko et al. |
| 6,223,554 | B1 | 5/2001 | Adachi |
| 8,602,760 | B2 | 12/2013 | Maeyama et al. |
| 2013/0064705 | A1 | 3/2013 | Sekiya et al. |

FOREIGN PATENT DOCUMENTS

| | | | | | |
|---|---|---|---|---|---|
| DE | 874 944 | C | | 4/1953 | |
| EP | 2 607 702 | A1 | | 6/2013 | |
| GB | 26718 | A | | 0/1910 | |
| GB | 244181 | A | | 12/1925 | |
| JP | 51-128704 | A | | 11/1976 | |
| JP | 52-60911 | A | | 5/1977 | |
| JP | 52-47571 | | | 12/1977 | |
| JP | 53-8809 | | | 1/1978 | |
| JP | 56-29001 | A | | 3/1981 | |
| JP | 58-70087 | | | 4/1983 | |
| JP | 61-132793 | | | 6/1986 | |
| JP | 63-73593 | U | | 5/1988 | |
| JP | 63-131883 | A | | 6/1988 | |
| JP | 4-187887 | | | 7/1992 | |
| JP | 5-133367 | A | | 5/1993 | |
| JP | 6-501758 | A | | 2/1994 | |
| JP | 8-247063 | A | | 9/1996 | |
| JP | 8-247064 | A | | 9/1996 | |
| JP | 10-252675 | | | 9/1998 | |
| JP | 2000-352390 | | | 12/2000 | |
| JP | 2009062820 | A | * | 3/2009 | ..... F04C 29/02 |
| WO | WO 2010/150816 | A1 | | 12/2010 | |
| WO | WO 2012/023427 | A1 | | 2/2012 | |

OTHER PUBLICATIONS

International Search Report and Written Opinion issued Jul. 2, 2013 in PCT/JP2013/059582 (with English translation of categories of cited documents).
Office Action issued Oct. 29, 2013 in Japanese Patent Application No. 2012-529553 (with English language translation).
Extended European Search Report issued Jun. 17, 2014 in Patent Application No. 11818068.6.
Extended European Search Report issued Jun. 17, 2014 in Patent Application No. 11818070.2.
Office Action mailed Aug. 14, 2014 in co-pending U.S. Appl. No. 13/700,634.
Office Action issued Sep. 30, 2014 in Japanese Patent Application No. 2012-002807 (with English language translation).
Office Action issued Sep. 30, 2014 in Japanese Patent Application No. 2012-003556 (with English language translation).
International Search Report issued Apr. 10, 2012, in PCT/JP12/000113 filed Jan. 11, 2012.
U.S. Appl. No. 14/350,989, filed Apr. 10, 2014, Sekiya, et al.
U.S. Appl. No. 14/350,937, filed Apr. 10, 2014, Sekiya, et al.
U.S. Appl. No. 14/350,959, filed Apr. 10, 2014, Sekiya, et al.
Combined Office Action and Search Report issued Aug. 17, 2015 in Chinese Patent Application No. 201280057084.1 (with English language translation and English translation of Category of Cited Documents).

* cited by examiner (a)

(b)

(a)

(b)

(a)

(b)

VANE COMPRESSOR HAVING A VANE SUPPORTER THAT SUPPRESSES LEAKAGE OF REFRIGERANT

TECHNICAL FIELD

The present invention relates to a vane compressor.

BACKGROUND ART

Hitherto, typical vane compressors have been proposed in each of which a rotor portion included in a rotor shaft (a unit including the rotor portion, which has a columnar shape and undergoes a rotational motion in a cylinder, and a shaft that transmits a rotational force to the rotor portion is referred to as rotor shaft) has one or a plurality of vane grooves in which vanes are fitted, respectively, the tips of the vanes being in contact with and sliding on the inner circumferential surface of the cylinder (see Patent Literature 1, for example).

Another proposed vane compressor includes a rotor shaft having a hollow thereinside. A fixed shaft provided for vanes is provided in the hollow. The vanes are rotatably attached to the fixed shaft. Furthermore, the vanes are each held between a pair of nipping members (a bush) provided closely to the outer circumference of the rotor portion, the vanes being held in such a manner as to be rotatable with respect to a rotor portion, the nipping members each having a semicircular stick-like shape (see Patent Literature 2, for example).

CITATION LIST

Patent Literature

Patent Literature 1: Japanese Unexamined Patent Application Publication No. 10-252675 (p. 4 and FIG. 1)

Patent Literature 2: Japanese Unexamined Patent Application Publication No. 2000-352390 (p. 6 and FIG. 1)

SUMMARY OF INVENTION

Technical Problem

In the known typical vane compressor disclosed by Patent Literature 1, there is a large difference between the radius of curvature at the tip of each vane and the radius of curvature of the inner circumferential surface of the cylinder. Therefore, no oil film is formed between the inner circumferential surface of the cylinder and the tip of the vane, producing a state of boundary lubrication instead of hydrodynamic lubrication. In general, the coefficient of friction, which depends on the state of lubrication, is about 0.001 to 0.005 in the case of hydrodynamic lubrication but is much higher, about 0.05 or above, in the case of boundary lubrication.

Hence, the configuration of the known typical vane compressor has a problem in that a significant reduction in the compressor efficiency due to an increase in mechanical loss occurs with an increase in the sliding resistance between the tip of the vane and the inner circumferential surface of the cylinder that slide on each other in a state of boundary lubrication. Moreover, the known typical vane compressor has another problem in that the tip of the vane and the inner circumferential surface of the cylinder are liable to wear, making it difficult to provide a long life.

To ease the above problems, a technology (see Patent Literature 2, for example) has been proposed in which a rotor portion having a hollow thereinside includes a fixed shaft that is provided in the hollow and supports vanes such that the vanes are rotatable about the center of the inner circumferential surface of a cylinder, the vanes being held between nipping members in such a manner as to be rotatable with respect to the rotor portion, the nipping members being provided closely to the outer circumference of the rotor portion.

In the above configuration, the vanes are rotatably supported at the center of the inner circumferential surface of the cylinder. Hence, the longitudinal direction of each of the vanes always corresponds to a direction toward the center of the inner circumferential surface of the cylinder. Accordingly, the vanes rotate with the tips thereof moving along the inner circumferential surface of the cylinder. Therefore, a very small gap is always provided between the tip of each of the vanes and the inner circumferential surface of the cylinder, allowing the vanes and the cylinder to behave without coming into contact with each other. Hence, no loss due to sliding at the tips of the vanes occurs. Thus, a vane compressor in which the tips of vanes and the inner circumferential surface of a cylinder do not wear is provided.

In the technology disclosed by Patent Literature 2, however, since the rotor portion has a hollow thereinside, it is difficult to provide a rotational force to the rotor portion and to rotatably support the rotor portion. According to Patent Literature 2, end plates are provided on two respective end facets of the rotor portion. One of the end plates has a disc-like shape out of the need for transmitting power from a rotating shaft. The rotating shaft is connected to the center of the end plate. The other end plate needs to have a ring shape having a hole in a central part thereof out of the need for avoiding the interference with the areas of rotation of the fixed shaft having the vanes and a vane shaft supporting member. Therefore, a portion that rotatably supports the end plate needs to have a larger diameter than the rotating shaft, leading to a problem of an increase in the loss due to sliding on bearings.

Moreover, since a small gap is provided between the rotor portion and the inner circumferential surface of the cylinder so as to prevent the leakage of a gas that has been compressed, the outside diameter and the center of rotation of the rotor portion need to be defined with high accuracy. Despite such circumstances, since the rotor portion and the end plates are provided as separate components, another problem arises in that the accuracy in the outside diameter and the center of rotation of the rotor portion may be deteriorated by any distortion, misalignment, or the like between the rotor portion and the end plates that may occur when they are connected to each other.

The present invention is to solve the above problems and to provide a vane compressor in which a vane is stably supported, the wear at the tip of the vane is suppressed, the loss due to sliding on bearings is reduced by supporting a rotating shaft portion with a small diameter, and the accuracy in the outside diameter and the center of rotation of a rotor portion is increased.

Solution to Problem

A vane compressor according to the present invention includes a compressing element that compresses a refrigerant. The compressing element includes a cylinder having a cylindrical inner circumferential surface; a rotor shaft provided in the cylinder and including a cylindrical rotor portion and a rotating shaft portion, the rotor portion being configured to rotate about an axis of rotation offset from a central axis of the inner circumferential surface by a predetermined distance, the rotating shaft portion being configured to transmit a rotational force from an outside to the rotor portion; a frame that closes one of openings defined by the inner circumferential surface of the cylinder and supports the rotating shaft portion by a main bearing portion thereof; a cylinder head that closes the other of the openings defined by the inner circumferential surface of the cylinder and supports the rotating shaft portion by a main bearing portion thereof; and at least one vane provided to the rotor portion and whose tip projects from the rotor portion and is shaped as an arc that is convex outward. The vane compressor further includes vane supporting means configured to support the vane such that the refrigerant is compressed in a space defined by the vane, an outer circumference of the rotor portion, and the inner circumferential surface of the cylinder and such that a line normal to the arc at the tip of the vane and a line normal to the inner circumferential surface of the cylinder always substantially coincide with each other, the vane supporting means being configured to support the vane such that the vane is rotatable and movable with respect to the rotor portion, the vane supporting means being configured to hold the vane such that a predetermined gap is provided between the tip of the vane and the inner circumferential surface of the cylinder in a state where the tip of the vane has moved by a maximum length toward the inner circumferential surface of the cylinder. The rotor shaft is an integral body including the rotor portion and the rotating shaft portion. An end facet of the vane that is close to an inner circumferential surface center, which is the center of the inner circumferential surface of the cylinder, is always positioned on an inner side of the rotor portion than a center of rotation of the vane that is rotatable with respect to the rotor portion.

Advantageous Effects of Invention

According to the present invention, providing a predetermined appropriate gap between the tip of the vane and the cylinder inner circumferential surface suppresses the leakage of the refrigerant at the tip, the reduction in the compressor efficiency due to an increase in the mechanical loss, and the wear of the tip. Furthermore, a mechanism that allows the vane necessary for performing the compressing operation to rotate about the center of the cylinder inner circumferential surface such that the line normal to the arc at the tip of the vane and the line normal to the cylinder inner circumferential surface always substantially coincide with each other is provided as an integral body including the rotor portion and the rotating shaft portion. Hence, the rotating shaft portion can be supported with a small diameter. Accordingly, the loss due to sliding on the bearings is reduced, the accuracy in the outside diameter and the center of rotation of the rotor portion is increased, and the loss due to leakage is reduced with a reduced gap provided between the rotor portion and the cylinder inner circumferential surface. Furthermore, since the end facet of the vane that is close to the inner circumferential surface center, which is the center of the inner circumferential surface of the cylinder, is always positioned on an inner side of the rotor portion than the center of rotation of the vane with respect to the rotor portion, the vane is allowed to stably rotate about the center of rotation thereof, whereby the vane is always stably supported.

DESCRIPTION OF EMBODIMENTS

Embodiment 1

Configuration of Vane Compressor 200

Figure 1:
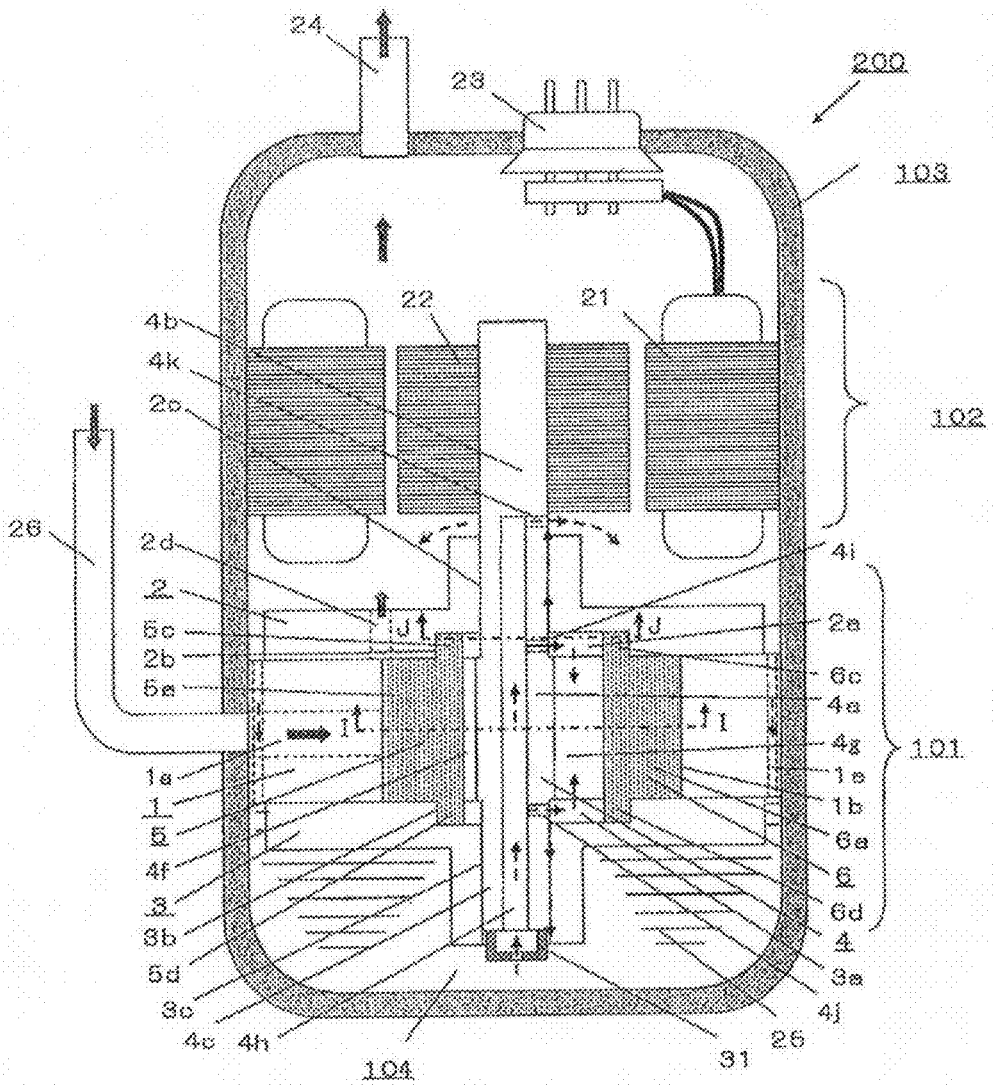
FIG. 1 is a vertical sectional view of a vane compressor 200 according to Embodiment 1 of the present invention.
Figure 2:
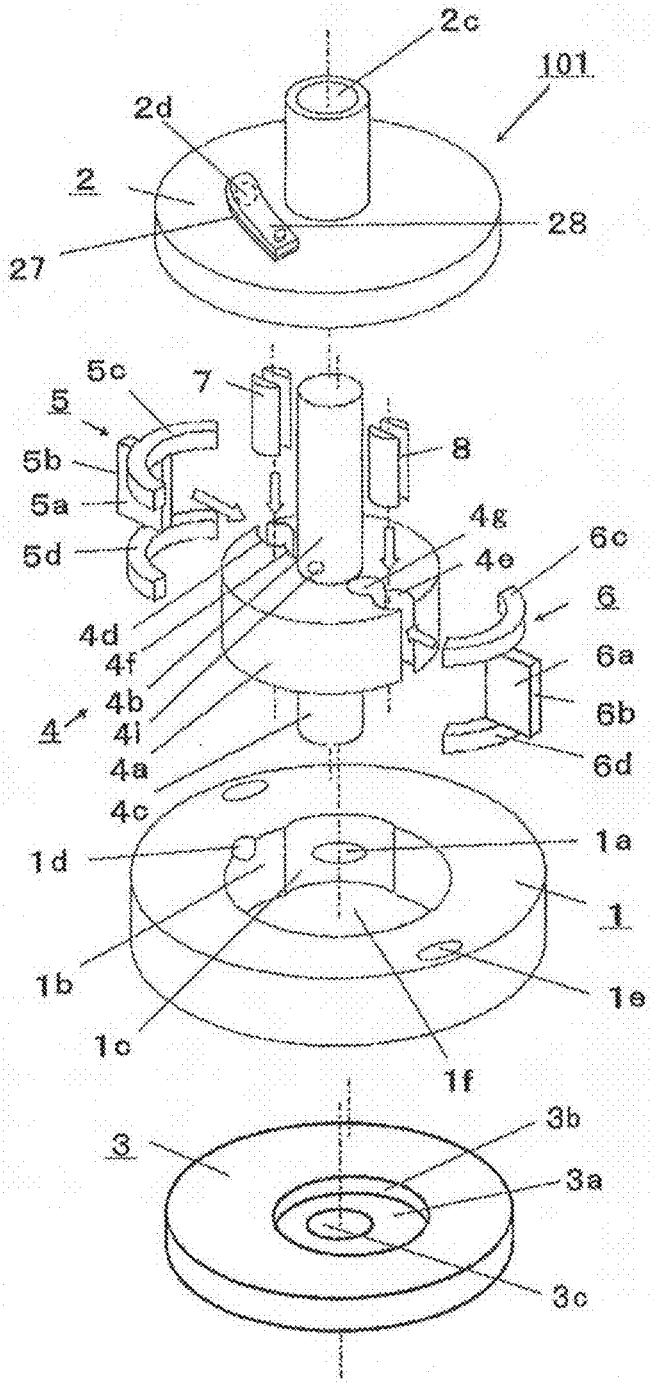
FIG. 2 is an exploded perspective view of a compressing element 101 included in the vane compressor 200 according to Embodiment 1 of the present invention.
Figure 3:
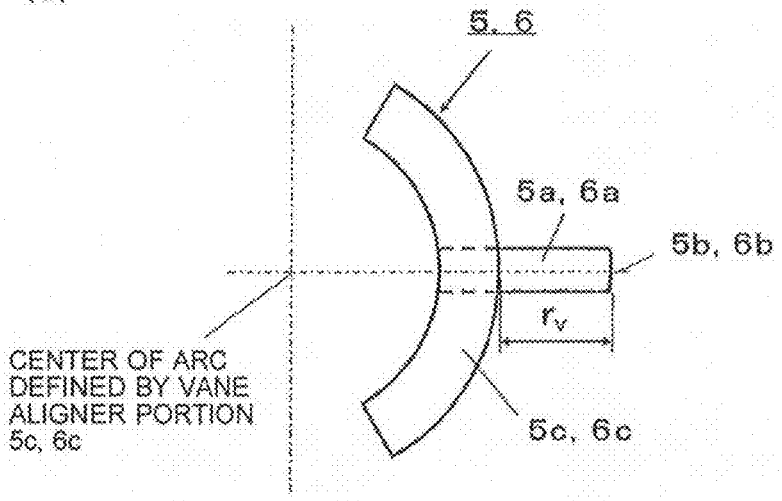
FIG. 3(*a*) and FIG. 3(*b*) include a plan view and a front view each illustrating a first vane 5 and a second vane 6 included in the vane compressor 200 according to Embodiment 1 of the present invention.
Figure 3:
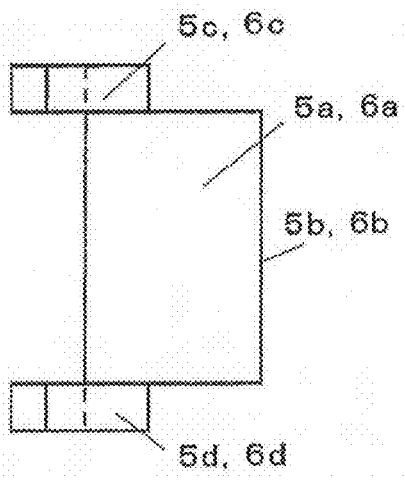

FIG. 1 is a vertical sectional view of a vane compressor 200 according to Embodiment 1 of the present invention. FIG. 2 is an exploded perspective view of a compressing element 101 included in the vane compressor 200. FIG. 3 includes a plan view and a front view each illustrating a first vane 5 and a second vane 6 included in the vane compressor 200. In FIG. 1, solid-line arrows represent the flow of a gas (refrigerant), and broken-line arrows represent the flow of a refrigerating machine oil 25. Referring to FIGS. 1 to 3, a configuration of the vane compressor 200 will now be described.

The vane compressor 200 according to Embodiment 1 includes a closed container 103 that defines the outer shape thereof, the compressing element 101 that is housed in the closed container 103, an motor element 102 that is provided above the compressing element 101 and drives the compressing element 101, and an oil reservoir 104 that is provided in and at the bottom of the closed container 103 and stores a refrigerating machine oil 25.

The closed container 103 defines the outer shape of the vane compressor 200 and houses the compressing element 101 and the motor element 102 thereinside. The closed container 103 stores the refrigerant and the refrigerating machine oil in a hermetical manner. A suction pipe 26 via which the refrigerant is sucked into the closed container 103 is provided on a side face of the closed container 103. A discharge pipe 24 via which the refrigerant that has been compressed is discharged to the outside is provided on the top face of the closed container 103.

The compressing element 101 compresses the refrigerant that has been sucked into the closed container 103 via the suction pipe 26 and includes a cylinder 1, a frame 2, a cylinder head 3, a rotor shaft 4, the first vane 5, the second vane 6, and bushes 7 and 8.

The cylinder 1 has a substantially cylindrical shape in its entirety and has a through portion 1*f* having a substantially circular shape and being axially eccentric in the axial direction with respect to a circle defined by the cylindrical shape. A part of a cylinder inner circumferential surface 1*b* forming the inner circumferential surface that defines the through portion 1*f* is recessed in a direction from the center of the through portion 1*f* toward the outer side and in a curved shape, whereby a notch 1*c* is provided. The notch 1*c* has a suction port 1*a*. The suction port 1*a* communicates with the suction pipe 26. The refrigerant is sucked into the through portion 1*f* via the suction port 1*a*. A discharge port 1*d* in the form of a notch is provided across a closest point 32, to be described below, from the suction port 1*a* and close to the closest point 32. The discharge port 1*d* is provided on a side facing the frame 2 of the cylinder 1 to be described below (see FIG. 2). The cylinder 1 has two oil return holes 1*e* provided in an outer periphery thereof and extending therethrough in the axial direction. The oil return holes 1*e* are provided at respective positions that are symmetrical to each other with respect to the center of the through portion 1*f*.

The frame 2 has a substantially T-shaped vertical section. A part of the frame 2 that is in contact with the cylinder 1 has a substantially disc-like shape. The frame 2 closes one of the openings (the upper one in FIG. 2) at the through portion 1*f* provided in the cylinder 1. The frame 2 has a cylindrical portion in a central part thereof. The cylindrical portion is hollow, thereby forming a main bearing portion 2*c*. A recess 2*a* is provided in an end facet of the frame 2 that is close to the cylinder 1 and in a part corresponding to the main bearing portion 2*c*. The outer circumferential surface of the recess 2*a* is concentric with respect to the cylinder inner circumferential surface 1*b*. A vane aligner portion 5*c* of the first vane 5 and a vane aligner portion 6*c* of the second vane 6, to be described below, are fitted in the recess 2*a*. The vane aligner portions 5*c* and 6*c* are supported by a vane aligner bearing portion 2*b* provided by the outer circumferential surface of the recess 2*a*. The frame 2 also has a discharge port 2*d* communicating with the discharge port 1*d* provided in the cylinder 1 and extending through the frame 2 in the axial direction. A discharge valve 27 and a discharge valve stopper 28 that regulates the opening degree of the discharge valve 27 are attached to one of the openings at the discharge port 2*d* that is farther from the cylinder 1.

The cylinder head 3 has a substantially T-shaped vertical section. A part of the cylinder head 3 that is in contact with the cylinder 1 has a substantially disc-like shape. The cylinder head 3 closes the other one of the openings (the lower one in FIG. 2) at the through portion 1*f* of the cylinder 1. The cylinder head 3 has a cylindrical portion in a central part thereof. The cylindrical portion is hollow, thereby forming a main bearing portion 3*c*. A recess 3*a* is provided in an end facet of the cylinder head 3 that is close to the cylinder 1 and in a part corresponding to the main bearing portion 3*c*. The outer circumferential surface of the recess 3*a* is concentric with respect to the cylinder inner circumferential surface 1*b*. A vane aligner portion 5*d* of the first vane 5 and a vane aligner portion 6*d* of the second vane 6, to be described below, are fitted in the recess 3*a*. The vane aligner portions 5*d* and 6*d* are supported by a vane aligner bearing portion 3*b* formed by the outer circumferential surface of the recess 3*a*.

The rotor shaft 4 is an integral body including a substantially cylindrical rotor portion 4*a* that is provided in the cylinder 1 and undergoes a rotational motion about a central axis that is eccentric with respect to the central axis of the through portion 1*f* of the cylinder 1, a rotating shaft portion 4*b* that extends perpendicularly upward from the center of a circular upper surface of the rotor portion 4*a*, and a rotating shaft portion 4*c* that extends perpendicularly downward from the center of a circular lower surface of the rotor portion 4*a*. The rotating shaft portion 4*b* extends through and is supported by the main bearing portion 2*c* of the frame 2. The rotating shaft portion 4*c* extends through and is supported by the main bearing portion 3*c* of the cylinder head 3. The rotor portion 4*a* includes bush holding portions 4*d* and 4*e* and vane relief portions 4*f* and 4*g* each extending through the rotor portion 4*a*, having a cylindrical shape, in the axial direction of the rotor portion 4*a* and having a substantially circular cross-sectional shape in a direction perpendicular to the axial direction. The bush holding portions 4*d* and 4*e* are provided at respective positions that are symmetrical to each other with respect to the center of the rotor portion 4*a*. The vane relief portions 4*f* and 4*g* are provided on the inner side of the respective bush holding portions 4*d* and 4*e*. That is, the centers of the rotor portion 4*a*, the bush holding portions 4*d* and 4*e*, and the vane relief portions 4*f* and 4*g* are aligned substantially linearly. Furthermore, the bush holding portion 4*d* and the vane relief portion 4*f* communicate with each other, and the bush holding portion 4*e* and the vane relief portion 4*g* communicate with each other. Furthermore, the axial ends of each of the vane relief portions 4*f* and 4*g* communicate with the recess 2*a* of the frame 2 and the recess 3*a* of the cylinder head 3, respectively. Furthermore, an oil pump 31 that utilizes the centrifugal force of the rotor shaft 4, such as that disclosed by, for example, Japanese Unexamined Patent Application Publication No. 2009-62820, is provided at the lower end of the rotating shaft portion 4*c* of the rotor shaft 4. The oil pump 31 at the lower end of the rotating shaft portion 4*c* resides in an axially central part of the rotating shaft portion 4*c* of the rotor shaft 4 and communicates with an oil supply path 4*h* extending upward from the lower end of the rotating shaft portion 4*c* through the rotor portion 4*a* up to a position in the rotating shaft portion 4*b*. The rotating shaft portion 4*b* has an oil supply path 4*i* that allows the oil supply path 4*h* and the recess 2*a* to communicate with each other. The rotating shaft portion 4*c* has an oil supply path 4*j* that allows the oil supply path 4*h* and the recess 3*a* to communicate with each other. Furthermore, the rotating shaft portion 4*b* has an oil discharge hole 4*k* at a position thereof above the main bearing portion 2*c*. The oil discharge hole 4*k* that allows the oil supply path 4*h* to communicate with the internal space of the closed container 103.

The first vane 5 includes a vane portion 5*a* that is a substantially rectangular plate-like member, the vane aligner portion 5*c* provided on the upper end facet of the vane portion 5*a* that is close to the frame 2 and the rotating shaft portion 4*b*, the vane aligner portion 5*c* having an arc shape, that is, shaped as a part of a ring; and the vane aligner portion 5*d* provided on the lower end facet of the vane portion 5*a* that is close to the cylinder head 3 and the rotating shaft portion 4*c*, the vane aligner portion 5*d* having an arc shape, that is, shaped as a part of a ring. A vane tip 5*b* as an end facet of the vane portion 5*a* that is close to the cylinder inner circumferential surface 1*b* has an arc shape that is convex outward. The radius of curvature of the arc is substantially the same as the radius of curvature of the cylinder inner circumferential surface 1*b*. As illustrated in FIG. 3(*a*), the first vane 5 is configured such that the normal line, extending in the longitudinal direction of the vane portion 5*a*, to the arc at the vane tip 5*b* pass through the center of the arc defined by each of the vane aligner portions 5*c* and 5*d*.

The second vane 6 includes a vane portion 6*a* that is a substantially rectangular plate-like member; the vane aligner portion 6*c* provided on the upper end facet of the vane portion 6*a* that is close to the frame 2 and the rotating shaft portion 4*b*, the vane aligner portion 6*c* having an arc shape, that is, shaped as a part of a ring; and the vane aligner portion 6*d* provided on the lower end facet of the vane portion 6*a* that is close to the cylinder head 3 and the rotating shaft portion 4*c*, the vane aligner portion 6*d* having an arc shape, that is, shaped as a part of a ring. A vane tip 6*b* as an end facet of the vane portion 6*a* that is close to the cylinder inner circumferential surface 1*b* has an arc shape that is convex outward. The radius of curvature of the arc is substantially the same as the radius of curvature of the cylinder inner circumferential surface 1*b*. As illustrated in FIG. 3(*a*), the second vane 6 is configured such that the longitudinal direction of the vane portion 6*a* and the direction of normal line to the arc at the vane tip 6*b* pass through the center of the are defined by each of the vane aligner portions 6*c* and 6*d*.

The bushes 7 and 8 each include a pair of members each having a substantially semicircular columnar shape. The bush 7 is fitted in the bush holding portion 4*d* of the rotor shaft 4. The vane portion 5*a* having a plate-like shape is held between the pair of members of the bush 7. In this state, the vane portion 5*a* is held in such a manner as to be rotatable with respect to the rotor portion 4*a* and movable in the longitudinal direction of the vane portion 5*a*. The bush 8 is fitted in the bush holding portion 4*e* of the rotor shaft 4. The vane portion 6*a* having a plate-like shape is held between the pair of members of the bush 8. In this state, the vane portion 6*a* is held in such a manner as to be rotatable with respect to the rotor portion 4*a* and movable in the longitudinal direction of the vane portion 6*a*.

The bush holding portions 4*d* and 4*e*, the vane relief portions 4*f* and 4*g*, the bushes 7 and 8, and the vane aligner bearing portions 2*b* and 3*b* correspond to "vane supporting means" according to the present invention.

The motor element 102 is, for example, a brushless DC motor and includes, as illustrated in FIG. 1, a stator 21 fixed to the inner circumference of the closed container 103, and a rotor 22 provided on the inner side of the stator 21 and including permanent magnets. The stator 21 receives electric power from a glass terminal 23 fixed to the upper surface of the closed container 103. The electric power drives the rotor 22 to rotate. The rotating shaft portion 4*b* of the rotor shaft 4 extends through and is fixed to the rotor 22. When the rotor 22 rotates, a rotational force of the rotor 22 is transmitted to the rotating shaft portion 4*b*, whereby the entirety of the rotor shaft 4 rotates.

Compressing Operation of Vane Compressor 200

Figure 4:
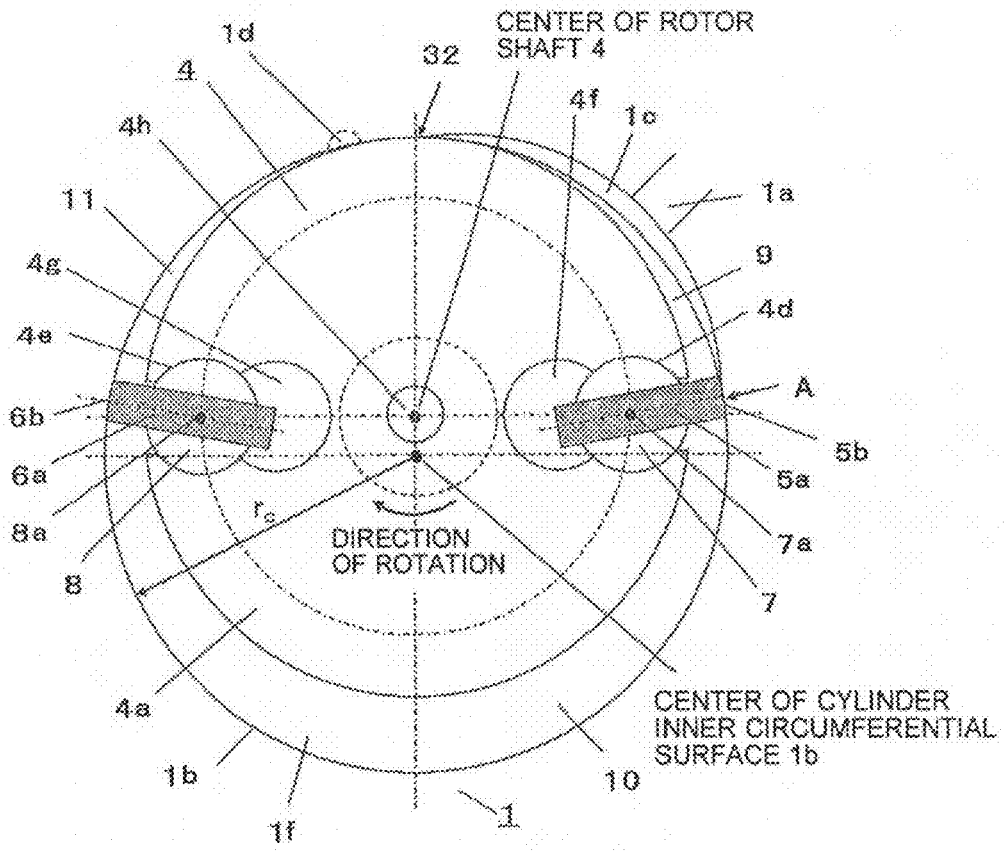
FIG. 4 is a sectional view of the vane compressor 200 according to Embodiment 1 of the present invention that is taken along line I-I illustrated in FIG. 1.
Figure 5:
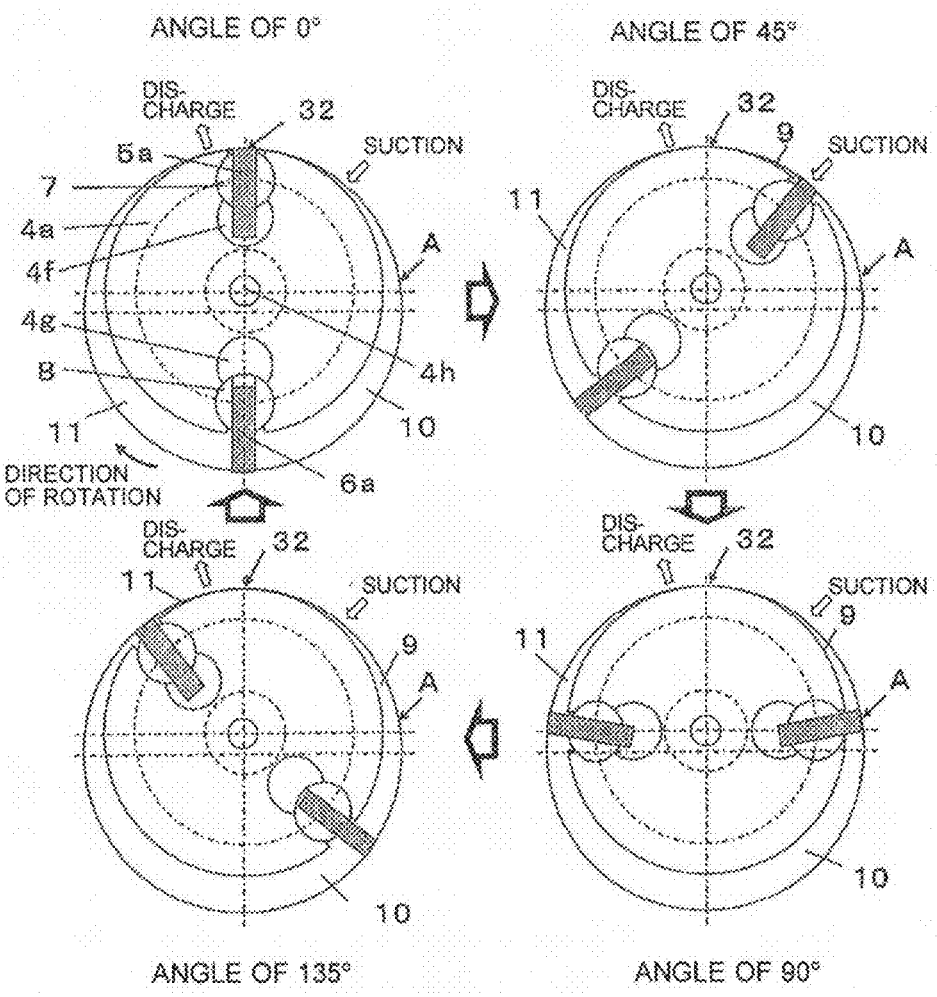
FIG. 5 includes diagrams illustrating a compressing operation performed by the vane compressor 200 according to Embodiment 1 of the present invention.

FIG. 4 is a sectional view of the vane compressor 200 according to Embodiment 1 of the present invention that is taken along line I-I illustrated in FIG. 1. FIG. 5 includes diagrams illustrating a compressing operation performed by the vane compressor 200. Referring to FIGS. 4 and 5, the compressing operation performed by the vane compressor 200 will now be described.

FIG. 5 illustrates states in each of which the rotor portion 4*a* of the rotor shaft 4 resides closest to a position (the closest point 32) on the cylinder inner circumferential surface 1*b*. With the radius of each of the vane aligner bearing portions 2*b* and 3*b* labeled as ra (see FIG. 6 to be referred to below) and the radius of the cylinder inner circumferential surface 1*b* being labeled as rc (see FIG. 4), a distance rv (see FIG. 3) between the outer circumferential side of each of the vane aligner portions 5*c* and 5*d* of the first vane 5 and the vane tip 5*b* is expressed by Expression (1) below.

$$rv=rc-ra-\delta \quad (1)$$

Here, δ denotes the gap between the vane tip 5*b* and the cylinder inner circumferential surface 1*b*. If rv is set as in Expression (1), the first vane 5 rotates with the vane tip 5*b* thereof being out of contact with the cylinder inner circumferential surface 1*b*. If rv is set such that δ is minimized, the leakage of the refrigerant at the vane tip 5*b* is minimized. The relationship expressed by Expression (1) also applies to the second vane 6. That is, the second vane 6 rotates while a small gap is provided between the vane tip 6*b* of the second vane 6 and the cylinder inner circumferential surface 1*b*.

In the above configuration, the closest point 32 where the rotor portion 4*a* resides closest to the cylinder inner circumferential surface 1*b*, the vane tip 5*b* of the first vane 5, and the vane tip 6*b* of the second vane 6 define three spaces (a suction chamber 9, an intermediate chamber 10, and a compression chamber 11) in the through portion 1*f* of the cylinder 1. The refrigerant that is sucked from the suction pipe 26 via the suction port 1*a* provided in the notch 1*c* flows into the suction chamber 9. As illustrated in FIG. 4 (the angular position of the rotor shaft 4 illustrated in FIG. 4 is defined as 90 degrees), the notch 1*c* extends from a position close to the closest point 32 to a position corresponding to a close to point A where the vane tip 5*b* of the first vane 5 and the cylinder inner circumferential surface 1*b* are close to each other. The compression chamber 11 communicates with the discharge port 2*d*, provided in the frame 2, via the discharge port 1*d* of the cylinder 1. The discharge port 2*d* is closed by the discharge valve 27 when the refrigerant is not discharged. Hence, the intermediate chamber 10 is a space that communicates with the suction port 1*a* at an angle of rotation of up to 90 degrees but does not communicate with either the suction port 1*a* or the discharge port 1*d* at an angle of rotation of over 90 degrees. At an angle of rotation of over 90 degrees, the intermediate chamber 10 communicates with the discharge port 1*d* and serves as the compression chamber 11. In FIG. 4, bush centers 7*a* and 8*a* are the centers of rotation of the respective bushes 7 and 8 and are also the centers of rotation of the respective vane portions 5*a* and 6*a*.

Now, a rotational motion of the rotor shaft 4 of the vane compressor 200 will be described.

The rotating shaft portion 4*b* of the rotor shaft 4 receives a rotational force from the rotor 22 of the motor element 102, whereby the rotor portion 4*a* rotates in the through portion 1*f* of the cylinder 1. With the rotation of the rotor portion 4*a*, the bush holding portions 4*d* and 4*e* of the rotor portion 4*a* move on the circumference of a circle that is centered on the center of the rotor shaft 4. Meanwhile, the pair of members included in each of the bushes 7 and 8 that are held by a corresponding one of the bush holding portions 4*d* and 4*e*, and each of the vane portion 5*a* of the first vane 5 and the vane portion 6*a* of the second vane 6 that is rotatably held between the pair of members included in a corresponding one of the bushes 7 and 8 also rotate with the rotation of the rotor portion 4*a*. The first vane 5 and the second vane 6 receive a centrifugal force produced by the rotation of the rotor portion 4*a*, whereby the vane aligner portions 5*c* and 6*c* and the vane aligner portions 5*d* and 6*d* are pressed against and slide along the respective vane aligner bearing portions 2*b* and 3*b* while rotating about the centers of the respective vane aligner bearing portions 2*b* and 3*b*. Here, since the vane aligner bearing portions 2*b* and 3*b* are concentric with respect to the cylinder inner circumferential surface 1*b*, the first vane 5 and the second vane 6 rotate about the center of the cylinder inner circumferential surface 1*b*. In such a case, the bushes 7 and 8 rotate about the respective bush centers 7*a* and 8*a* in the respective bush holding portions 4*d* and 4*e* such that a line extending in the longitudinal direction of each of the vane portion 5*a* of the first vane 5 and the vane portion 6*a* of the second vane 6 passes through the center of the cylinder inner circumferential surface 1*b*. That is, the rotor portion 4*a* rotates in a state where the line normal to the arc at each of the vane tips 5*b* and 6*b* and the line normal to the cylinder inner circumferential surface 1*b* always substantially coincide with each other.

In the above motion, the bush 7 and the vane portion 5*a* of the first vane 5 slide on each other by side faces thereof, and the bush 8 and the vane portion 6*a* of the second vane 6 slide on each other by side faces thereof. Furthermore, the bush holding portion 4*d* of the rotor shaft 4 and the bush 7 slide on each other, and the bush holding portion 4*e* of the rotor shaft 4 and the bush 8 slide on each other.

Referring now to FIG. 5, how the capacities of the suction chamber 9, the intermediate chamber 10, and the compression chamber 11 change will be described. In FIG. 5, for easier illustration, the suction port 1*a*, the notch 1*c*, and the discharge port 1*d* are not illustrated. Instead, the suction port 1*a* and the discharge port 1*d* are represented by arrows denoted by "suction" and "discharge", respectively. First, with the rotation of the rotor shaft 4, a low-pressure gas refrigerant flows into the suction port 1*a* from the suction pipe 26. Here, in FIG. 5, the angle of rotation at which the closest point 32 where the rotor portion 4*a* of the rotor shaft 4 and the cylinder inner circumferential surface 1*b* are closest to each other coincides with a position where the vane portion 5*a* and the cylinder inner circumferential surface 1*b* face each other is defined as "the angle of 0 degrees". FIG. 5 illustrates the positions of the vane portion 5*a* and the vane portion 6*a* and the states of the suction chamber 9, the intermediate chamber 10, and the compression chamber 11 at "the angle of 0 degrees", at "the angle of 45 degrees", at "the angle of 90 degrees", and at "the angle of 135 degrees". In the diagram included in FIG. 5 that illustrates the state at "the angle of 0 degrees", the direction of rotation of the rotor shaft 4 (the clockwise direction in FIG. 5) is represented by an arrow. In the other diagrams included in FIG. 5 that illustrate the states at the other angles, the arrow representing the direction of rotation of the rotor shaft 4 is omitted. States at "the angle of 180 degrees" and larger angles are not illustrated because a state that is the same as that at "the angle of 0 degrees" is established at "the angle of 180 degrees" with the first vane 5 and the second vane 6 being interchanged with each other, and, thereafter, the compression operation progresses in the same manner as for the transition from "the angle of 0 degrees" to "the angle of 135 degrees".

At "the angle of 0 degrees" illustrated in FIG. 5, the right one of the spaces defined between the closest point 32 and the vane portion 6*a* of the second vane 6 is the intermediate chamber 10, which communicates with the suction port 1*a* via the notch 1*c* and into which the gas refrigerant is sucked. The left one of the spaces defined between the closest point 32 and the vane portion 6*a* of the second vane 6 is the compression chamber 11, which communicates with the discharge port 1*d*.

At "the angle of 45 degrees" illustrated in FIG. 5, a space defined between the vane portion 5*a* of the first vane 5 and the closest point 32 is the suction chamber 9. The intermediate chamber 10 defined between the vane portion 5*a* of the first vane 5 and the vane portion 6*a* of the second vane 6 communicates with the suction port 1*a* via the notch 1*c* and has a capacity increased from that at "the angle of 0 degrees". Therefore, the suction of the gas refrigerant continues. A space defined between the vane portion 6*a* of the second vane 6 and the closest point 32 is the compression chamber 11. The capacity of the compression chamber 11 is reduced from that at "the angle of 0 degrees". Therefore, the gas refrigerant is compressed, and the pressure thereof gradually increases.

At "the angle of 90 degrees" illustrated in FIG. 5, since the vane tip 5*b* of the first vane 5 reaches the close to point A on the cylinder inner circumferential surface 1*b*, the intermediate chamber 10 loses communication with the suction port 1*a*. Therefore, the suction of the gas refrigerant into the intermediate chamber 10 ends. In this state, the capacity of the intermediate chamber 10 is substantially largest. The capacity of the compression chamber 11 is further reduced from that at "the angle of 45 degrees", and the pressure of the gas refrigerant increases. The capacity of the suction chamber 9 is increased from that at "the angle of 45 degrees". Therefore, the suction chamber 9 communicates with the suction port 1*a* via the notch 1*c*, and the gas refrigerant is sucked thereinto.

At "the angle of 135 degrees" illustrated in FIG. 5, the capacity of the intermediate chamber 10 is reduced from that at "the angle of 90 degrees", and the pressure of the refrigerant increases. The capacity of the compression chamber 11 is also reduced from that at "the angle of 90 degrees", and the pressure of the refrigerant increases. The capacity of the suction chamber 9 is increased from that at "the angle of 90 degrees". Therefore, the suction of the gas refrigerant continues.

Subsequently, the vane portion 6*a* of the second vane 6 comes close to the discharge port 1*d*. When the pressure of the gas refrigerant in the compression chamber 11 exceeds a high pressure in a refrigeration cycle (including a pressure required for opening the discharge valve 27), the discharge valve 27 opens. Then, the gas refrigerant in the compression chamber 11 flows into the discharge port 1*d* and the discharge port 2*d* and is discharged into the closed container 103 as illustrated in FIG. 1. The gas refrigerant discharged into the closed container 103 flows through the motor element 102, the discharge pipe 24 fixed to the upper portion of the closed container 103, and is discharged to the outside (to a high-pressure side of the refrigeration cycle). Accordingly, the inside of the closed container 103 is at a high pressure corresponding to a discharge pressure.

After the vane portion 6*a* of the second vane 6 passes the discharge port 1*d*, a small amount of high-pressure gas refrigerant remains (as a loss) in the compression chamber 11.

When the compression chamber 11 disappears at "the angle of 180 degrees" (not illustrated), the high-pressure gas refrigerant turns into a low-pressure gas refrigerant in the suction chamber 9. At "the angle of 180 degrees", the suction chamber 9 turns into the intermediate chamber 10, and the intermediate chamber 10 turns into the compression chamber 11. Subsequently, the above compressing operation is repeated.

With the rotation of the rotor portion 4*a* of the rotor shaft 4, the capacity of the suction chamber 9 gradually increases. Therefore, the suction of the gas refrigerant continues. Subsequently, the suction chamber 9 turns into the intermediate chamber 10. Before that (before the vane portion (the vane portion 5*a* or the vane portion 6*a*) that separates the suction chamber 9 and the intermediate chamber 10 from each other reaches the close to point A), the capacity of the suction chamber 9 gradually increases, and the suction of the gas refrigerant continues further. In this process, the capacity of the intermediate chamber 10 becomes largest, and the intermediate chamber 10 goes out of communication with the suction port 1*a*, whereby the suction of the gas refrigerant ends. Subsequently, the capacity of the intermediate chamber 10 is gradually reduced, whereby the gas refrigerant is compressed. Subsequently, the intermediate chamber 10 turns into the compression chamber 11, and the compression of the gas refrigerant continues. The gas refrigerant that has been compressed to a predetermined pressure flows through the discharge port 1*d* and the discharge port 2*d*, pushes up the discharge valve 27, and is discharged into the closed container 103.

Figure 6:
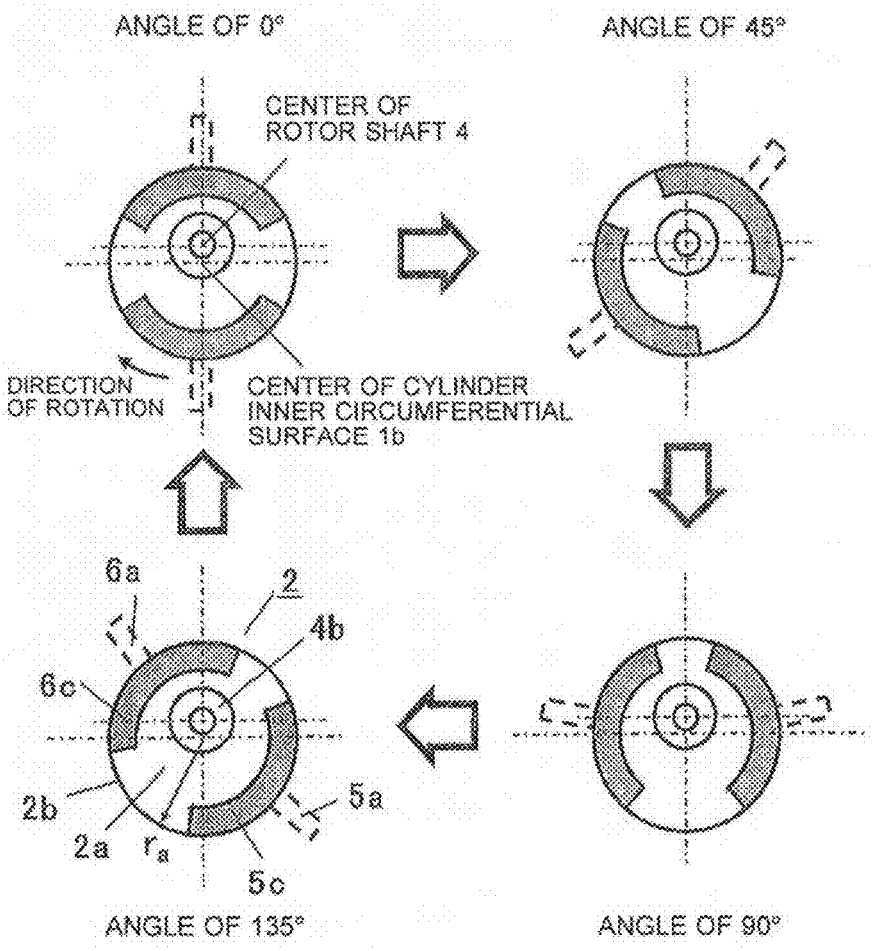
FIG. 6 includes sectional views each taken along line J-J illustrated in FIG. 1 and illustrating rotational motions of vane aligner portions 5*c* and 6*c* included in the vane compressor 200 according to Embodiment 1 of the present invention.

FIG. 6 includes sectional views each taken along line J-J illustrated in FIG. 1 and illustrating the rotational motion of the vane aligner portions 5*c* and 6*c* included in the vane compressor 200 according to Embodiment 1 of the present invention.

In the diagram included in FIG. 6 that illustrates "the angle of 0 degrees", the direction of rotation of the vane aligner portions 5*c* and 6*c* (the clockwise direction in FIG. 6) is represented by an arrow. In the other diagrams included in FIG. 6 that illustrate the other angles, the arrow representing the direction of rotation of the vane aligner portions 5*c* and 6*c* is omitted. With the rotation of the rotor shaft 4, the vane portion 5*a* of the first vane 5 and the vane portion 6*a* of the second vane 6 rotate about the center of the cylinder inner circumferential surface 1*b*. Hence, as illustrated in FIG. 6, the vane aligner portions 5*c* and 6*c* supported by the vane aligner bearing portion 2*b* rotate in the recess 2*a* about the center of the cylinder inner circumferential surface 1*b*. Likewise, the vane aligner portions 5*d* and 6*d* supported by the vane aligner bearing portion 3*b* rotate in the recess 3*a* about the center of the cylinder inner circumferential surface 1*b*.

Behavior of Refrigerating Machine Oil 25

In the above motion, referring to FIG. 1, when the rotor shaft 4 rotates, the refrigerating machine oil 25 is sucked from the oil reservoir 104 by the oil pump 31 and is fed into the oil supply path 4*h*. The refrigerating machine oil 25 that has been fed into the oil supply path 4*h* is fed into the recess 2*a* of the frame 2 via the oil supply path 4*i* and into the recess 3*a* of the cylinder head 3 via the oil supply path 4*j*. The refrigerating machine oil 25 that has been fed into the recesses 2*a* and 3*a* lubricates the vane aligner bearing portions 2*b* and 3*b* and is supplied into the vane relief portions 4*f* and 4*g* that communicate with the recesses 2*a* and 3*a*. In this step, the inside of the closed container 103 is at a high pressure corresponding to the discharge pressure. Accordingly, the insides of the recesses 2*a* and 3*a* and in the vane relief portions 4*f* and 4*g* are also at the discharge pressure. Portions of the refrigerating machine oil 25 that have been fed into the recesses 2*a* and 3*a* are supplied to and lubricate the main bearing portion 2*c* of the frame 2 and the main bearing portion 3*c* of the cylinder head 3, respectively.

Figure 7:
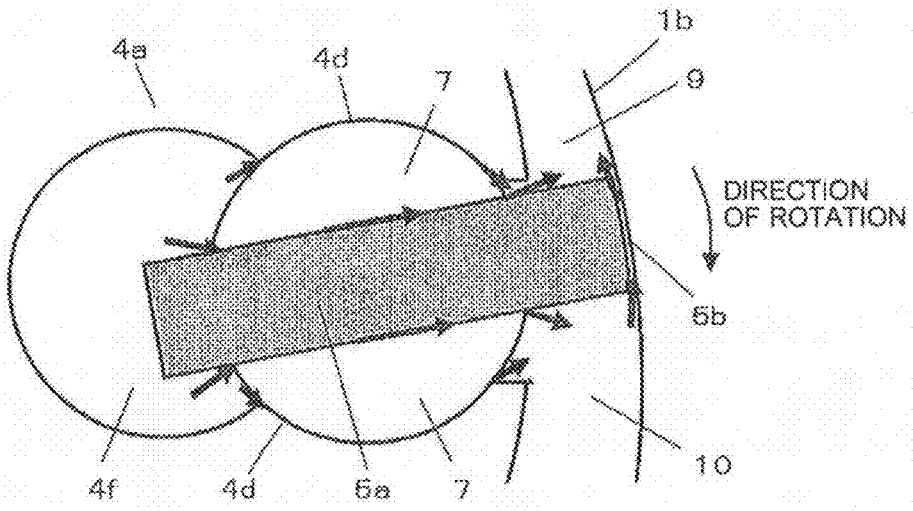
FIG. 7 is a sectional view illustrating a vane portion 5*a* of the first vane 5 and associated elements included in the vane compressor 200 according to Embodiment 1 of the present invention.

FIG. 7 is a sectional view illustrating principal portions of the vane portion 5*a* of the first vane 5 and associated elements included in the vane compressor 200 according to Embodiment 1 of the present invention.

In FIG. 7, the solid-line arrows represent the flow of the refrigerating machine oil 25. The inside of the vane relief portion 4*f* is at the discharge pressure that is higher than the pressures in the suction chamber 9 and the intermediate chamber 10. Therefore, the pressure difference and the centrifugal force cause the refrigerating machine oil 25 to be fed into the suction chamber 9 and the intermediate chamber 10 while lubricating sliding portions between the bush 7 and the side faces of the vane portion 5*a*. The pressure difference and the centrifugal force cause the refrigerating machine oil 25 to also lubricate sliding portions between the bush 7 and the bush holding portion 4*d* of the rotor shaft 4 while being fed into the suction chamber 9 and the intermediate chamber 10. A portion of the refrigerating machine oil 25 that has been fed into the intermediate chamber 10 flows into the suction chamber 9 while sealing the gap between the vane tip 5*b* and the cylinder inner circumferential surface 1*b*.

While the above description concerns a situation where the vane portion 5*a* of the first vane 5 separates the suction chamber 9 and the intermediate chamber 10 from each other, the same applies to a situation established with further rotation of the rotor shaft 4 where the vane portion 5*a* of the first vane 5 separates the intermediate chamber 10 and the compression chamber 11 from each other. That is, even in a case where the pressure in the compression chamber 11 has reached the discharge pressure that is the same as the pressure in the vane relief portion 4*f*, the refrigerating machine oil 25 is fed toward the compression chamber 11 with the centrifugal force.

While the above description concerns the motion of the first vane 5, the same applies to the second vane 6.

As illustrated in FIG. 1, the portion of the refrigerating machine oil 25 that has been supplied to the main bearing portion 2*c* flows through the gap between the main bearing portion 2*c* and the rotating shaft portion 4*b* and is discharged into the space above the frame 2. Subsequently, the refrigerating machine oil 25 flows through the oil return holes 1*e* provided in the outer periphery of the cylinder 1 and is fed back to the oil reservoir 104. Meanwhile, the portion of the refrigerating machine oil 25 that has been supplied to the main bearing portion 3*c* flows through the gap between the main bearing portion 3*c* and the rotating shaft portion 4*c* and is fed back to the oil reservoir 104. Furthermore, the portions of the refrigerating machine oil 25 that have been fed into the suction chamber 9, the intermediate chamber 10, and the compression chamber 11 via the vane relief portions 4*f* and 4*g* are eventually discharged into the space above the frame 2 via the discharge port 2*d* together with the gas refrigerant and are fed back to the oil reservoir 104 via the oil return holes 1*e* provided in the outer periphery of the cylinder 1. In the refrigerating machine oil 25 that has been fed into the oil supply path 4*h* by the oil pump 31, an excessive portion of the refrigerating machine oil 25 is discharged into the space above the frame 2 via the oil discharge hole 4*k* provided at an upper position of the rotor shaft 4, and is fed back to the oil reservoir 104 via the oil return holes 1*e* provided in the outer periphery of the cylinder 1.

Configurations and Behaviors of Vane Portions 5*a* and 6*a* and Bushes 7 and 8

Figure 8:
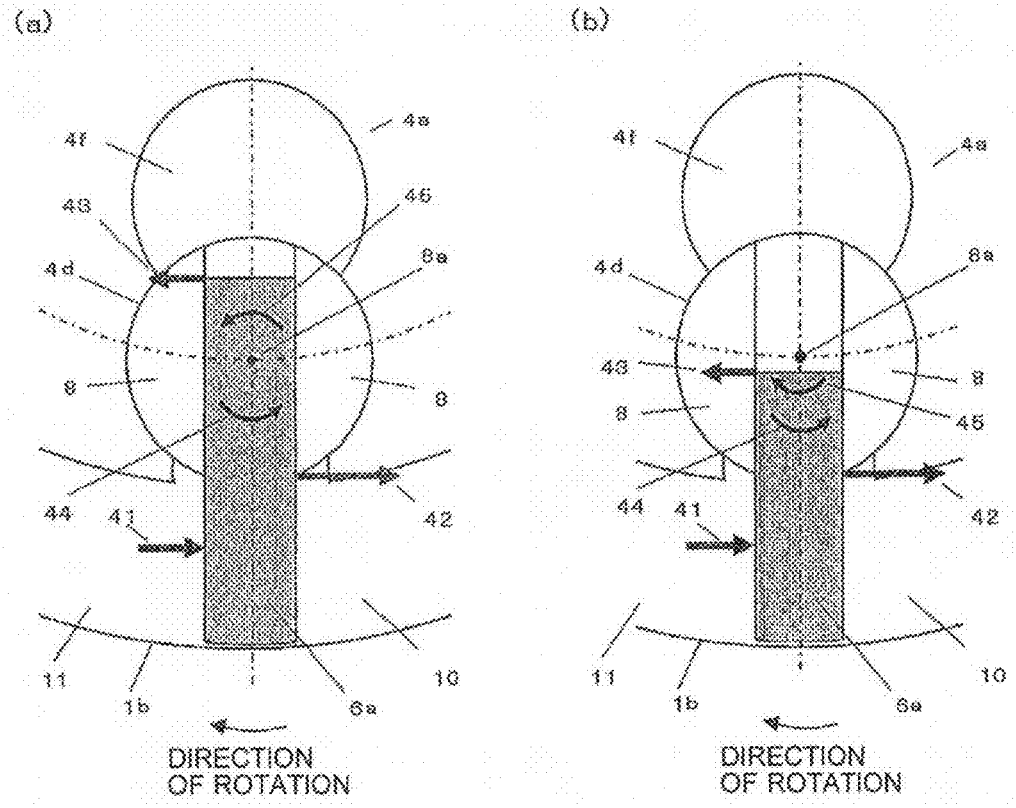
FIG. 8(*a*) and FIG. 8(*b*) include diagrams illustrating configurations and behaviors of a vane portion 6*a* and associated elements included in the vane compressor 200 according to Embodiment 1 of the present invention.

FIG. 8(*a*) and FIG. 8(*b*) include diagrams illustrating configurations and behaviors of the vane portion 6*a* and associated elements included in the vane compressor 200 according to Embodiment 1 of the present invention. FIG. 8(*a*) and FIG. 8(*b*) illustrate loads acting on the bush 8 that holds the vane portion 6*a* of the second vane 6 and in the state of "the angle of 0 degrees". FIG. 8(*a*) illustrates the configuration of the vane portion 6*a* and associated elements included in the vane compressor 200 according to Embodiment 1. FIG. 8(*b*) illustrates a case where an end of the vane portion 6*a* that is close to the center of the cylinder inner circumferential surface 1*b* (hereinafter simply referred to as "the inner circumferential surface center") resides on the outer side with respect to the bush center 8*a*.

First, a behavior of the vane portion 6*a* of the second vane 6 according to Embodiment 1 will be described with reference to FIG. 8(*a*).

As illustrated in FIG. 8(*a*), a load represented by an arrow 41 (a direction from the compression chamber 11 toward the intermediate chamber 10) produced by the pressure difference between the compression chamber 11 and the intermediate chamber 10 acts on the vane portion 6*a* of the second vane 6. The load represented by the arrow 41 urges the vane portion 6*a* to rotate counterclockwise in FIG. 8(*a*). Hence, a part of a sliding surface of the right one of the members included in the bush 8 that is on a side farther from the inner circumferential surface center and a part of the right side face of the vane portion 6*a* that is on the outer side with respect to the bush center 8*a* come into contact with each other. Therefore, a load in a direction represented by an arrow 42 (a direction in which the bush 8 rotates counterclockwise about the bush center 8*a*) acts on the bush 8. Furthermore, a part of a sliding surface of the left one of the members included in the bush 8 that is on a side close to the inner circumferential surface center and a part of the left side face of the vane portion 6*a* that is on the inner side with respect to the bush center 8*a* come into contact with each other. Therefore, a load in a direction represented by an arrow 43 (the direction in which the bush 8 rotates counterclockwise about the bush center 8*a*) acts on the bush 8. In this case, the bush 8 receives a moment 44 produced by the load represented by the arrow 42 and acting about the bush center 8*a* and a moment 45 produced by the load represented by the arrow 43 and acting about the bush center 8*a*. This enables the bush 8 to stably rotate about the bush center 8*a*.

Referring now to FIG. 8(*b*), a behavior of the vane portion 6*a* in a case where the end of the vane portion 6*a* that is close to the inner circumferential surface center resides on the outer side with respect to the bush center 8*a* will be described.

In FIG. 8(*b*) also, the pressure difference between the compression chamber 11 and the intermediate chamber 10 produces a load represented by the arrow 41 (in the direction from the compression chamber 11 toward the intermediate chamber 10) that acts on the vane portion 6*a* of the second vane 6. The load represented by the arrow 41 urges the vane portion 6*a* to rotate counterclockwise in FIG. 8(*b*). Hence, a part of the sliding surface of the right one of the members included in the bush 8 that is on the side farther from the inner circumferential surface center and a part of the right side face of the vane portion 6*a* that is on the outer side with respect to the bush center 8*a* come into contact with each other. Therefore, a load in the direction represented by the arrow 42 (the direction in which the bush 8 rotates counterclockwise about the bush center 8*a*) acts on the bush 8. Furthermore, a part of the sliding surface of the left one of the members included in the bush 8 that is on the side farther from the inner circumferential surface center and a part of the left side face of the vane portion 6*a* that is on the outer side with respect to the bush center 8*a* come into contact with each other. Therefore, a load in the direction represented by the arrow 43 (a direction in which the bush 8 rotates clockwise about the bush center 8*a*) acts on the bush 8. In this case, a moment 44 produced about the bush center 8*a* by the load represented by the arrow 42 acts counterclockwise, whereas a moment 45 produced about the bush center 8*a* by the load represented by the arrow 43 acts clockwise. Therefore, it is difficult for the bush 8 to stably rotate about the bush center 8*a*.

Hence, to allow the bush 8 to stably rotate about the bush center 8*a*, the end of the vane portion 6*a* that is close to the inner circumferential surface center needs to be always positioned on the inner side with respect to the bush center 8*a* as illustrated in FIG. 8(*a*). The end of the vane portion 6*a* that is close to the inner circumferential surface center is positioned closest to the bush center 8*a* in the state illustrated in FIG. 8 (the state at "the angle of 0 degrees"). Therefore, the end of the vane portion 6*a* that is nearer to the inner circumferential surface center of the vane portion 6*a* only needs to be positioned on the inner side with respect to the bush center 8*a* in that state.

While the configurations and behaviors of the vane portion 6*a* of the second vane 6 and the bush 8 have been described referring to FIG. 8, the same applies to the vane portion 5*a* of the first vane 5 and the bush 7. An end of the vane portion 5*a* that is close to the inner circumferential surface center needs to be always positioned on the inner side with respect to the bush center 7*a*.

While the end of the vane portion 6*a* of the second vane 6 that is close to the inner circumferential surface center does not project toward the inner side with respect to an end of the bush 8 that is close to the inner circumferential surface center as illustrated in FIG. 8(*a*), the present invention is not limited to such a case. Needless to say, the end of the vane portion 6*a* that is close to the inner circumferential surface center may project toward the inner side with respect to the end of the bush 8 that is close to the inner circumferential surface center. However, to reduce the outside diameter of the rotor portion 4*a* for a reduction in the diameter of the vane compressor 200, it is desirable to minimize the distance between the bush center 8*a* and the end of the vane portion 6*a* of the second vane 6 that is close to the inner circumferential surface center. That is, at "the angle of 0 degrees", if the end of the vane portion 6*a* of the second vane 6 that is close to the inner circumferential surface center does not project toward the inner side with respect to the end of the bush 8 that is close to the inner circumferential surface center as illustrated in FIG. 8(*a*), the outside diameter of the rotor portion 4*a* can be made much smaller, realizing a reduction in the diameter of the vane compressor 200.

Advantageous Effects of Embodiment 1

As described above, providing a predetermined appropriate gap δ between the cylinder inner circumferential surface 1*b* and each of the vane tips 5*b* and 6*b* such that the relationship of Expression (1) given above holds suppresses the leakage of the refrigerant at the vane tips 5*b* and 6*b*, the reduction in the compressor efficiency due to an increase in the mechanical loss, and the wear of the vane tips 5*b* and 6*b*.

Furthermore, since the radius of curvature of the arc at each of the vane tip 5*b* of the first vane 5 and the vane tip 6*b* of the second vane 6 is substantially the same as the radius of curvature of the cylinder inner circumferential surface 1*b*, a state of hydrodynamic lubrication is produced between the cylinder inner circumferential surface 1*b* and each of the vane tips 5*b* and 6*b*, whereby the sliding resistance is reduced, and the mechanical loss is thus reduced.

Furthermore, a mechanism that allows the vanes (the first vane 5 and the second vane 6) necessary for performing the compressing operation to rotate about the center of the cylinder inner circumferential surface 1*b* such that the line normal to the arc at each of the vane tips 5*b* and 6*b* and the line normal to the cylinder inner circumferential surface 1*b* always substantially coincide with each other is provided as an integral body including the rotor portion 4*a* and the rotating shaft portions 4*b* and 4*c*. Hence, the rotating shaft portions 4*b* and 4*c* can be each supported with a small diameter. Accordingly, the loss due to sliding on the bearings is reduced, the accuracy in the outside diameter and the center of rotation of the rotor portion 4*a* is increased, and the loss due to leakage is reduced with a reduced gap provided between the rotor portion 4*a* and the cylinder inner circumferential surface 1*b*.

Furthermore, since the end of each of the vane portions 5*a* and 6*a* that is close to the inner circumferential surface center is always positioned on the inner side with respect to a corresponding one of the bush centers 7*a* and 8*a*, the bushes 7 and 8 stably rotate about the respective bush centers 7*a* and 8*a*, whereby the vane portions 5*a* and 6*a* are always stably supported. In this case, at an angle of rotation of the rotor portion 4*a* at which the end of each of the vane portions 5*a* and 6*a* that is close to the inner circumferential surface center resides closest to a corresponding one of the bush centers 7*a* and 8*a*, if the end of each of the vane portions 5*a* and 6*a* that is close to the inner circumferential surface center does not project toward the inner side with respect to the end of a corresponding one of the bushes 7 and 8 that is close to the inner circumferential surface center, the outside diameter of the rotor portion 4*a* can be reduced, whereby the size of the vane compressor 200 can be reduced.

While Embodiment 1 concerns a case where two vanes, which are the first vane 5 and the second vane 6, are provided to the rotor portion 4*a* of the rotor shaft 4, the present invention is not limited to such a case. One vane or three or more vanes may be provided.

Furthermore, while the vane relief portions 4*f* and 4*g* each have a substantially circular cross-sectional shape as illustrated in FIGS. 4, 7, 8(*a*) and 8(*b*), the present invention is not limited to such a case. The vane relief portions 4*f* and 4*g* may each have any shape (for example, an oblong shape or a rectangular shape) as long as the vane portions 5*a* and 6*a* are out of contact with the inner circumferential surfaces of the respective vane relief portions 4*f* and 4*g*.

Furthermore, while FIG. 1 illustrates a configuration in which the frame 2 and the cylinder head 3 have the respective recesses 2*a* and 3*a* whose outer circumferential surfaces form the respective vane aligner bearing portions 2*b* and 3*b* that are concentric with respect to the cylinder inner circumferential surface 1*b*, the present invention is not limited to such a case. That is, the recesses 2*a* and 3*a* may each have any shape as long as the vane aligner bearing portions 2*b* and 3*b* are concentric with respect to the cylinder inner circumferential surface 1*b* and the vane aligner portions 5*c*, 6*c*, 5*d*, and 6*d* are fittable into the recesses 2*a* and 3*a*. For example, the recesses 2*a* and 3*a* may be ring-shaped grooves into which the vane aligner portions 5*c*, 6*c*, 5*d*, and 6*d* are fittable.

Embodiment 2

A vane compressor 200 according to Embodiment 2 will now be described, focusing on differences from the vane compressor 200 according to Embodiment 1.

Configurations of First Vane 5 and Second Vane 6

Figure 9:
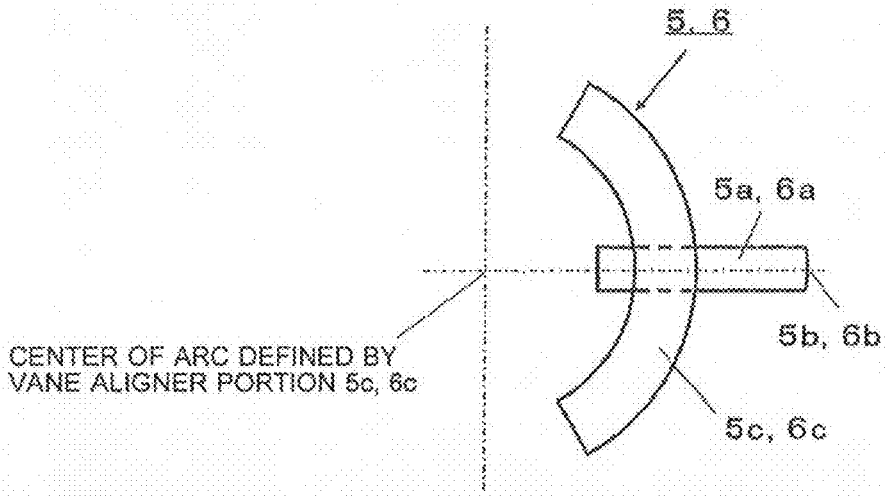
FIG. 9(*a*) and FIG. 9(*b*) include a plan view and a front view illustrating a first vane 5 and a second vane 6 of a vane compressor 200 according to Embodiment 2 of the present invention.
Figure 9:
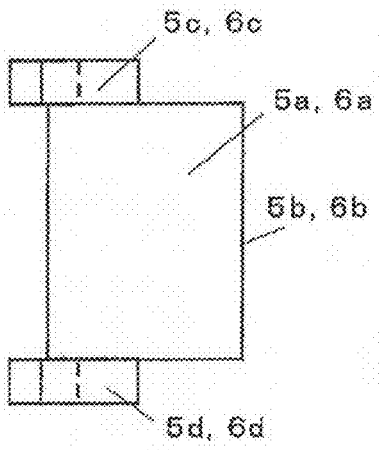

FIG. 9(*a*) and FIG. 9(*b*) include a plan view and a front view illustrating a first vane 5 and a second vane 6 of the vane compressor 200 according to Embodiment 2 of the present invention.

As illustrated in FIG. 9(*a*) and FIG. 9(*b*), the end of each of a vane portion 5*a* of the first vane 5 and a vane portion 6*a* of the second vane 6 that is close to the inner circumferential surface center projects toward the inner circumferential surface center with respect to the inner sides of the vane aligner portions 5*c* and 5*d* or the vane aligner portions 6*c* and 6*d*. Thus, the end of each of the vane portions 5*a* and 6*a* that is close to the inner circumferential surface center project more toward the inner circumferential surface center than in Embodiment 1. Consequently, the outer size of the rotor portion 4*a* can be made smaller than in Embodiment 1, realizing a reduction in the size of the vane compressor 200.

Figure 10:
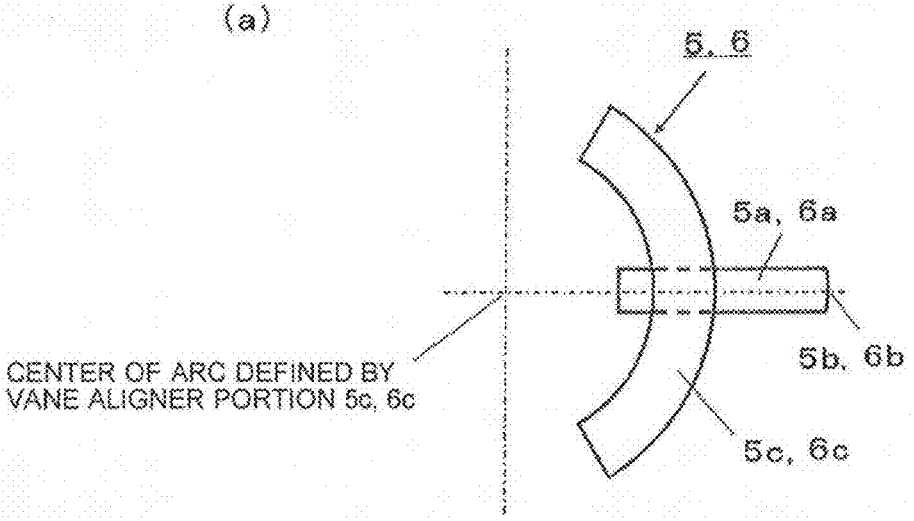
FIG. 10(*a*) and FIG. 10(*b*) include a plan view and a front view illustrating a modification of the first vane 5 and the second vane 6 of the vane compressor 200 according to Embodiment 2 of the present invention.
Figure 10:
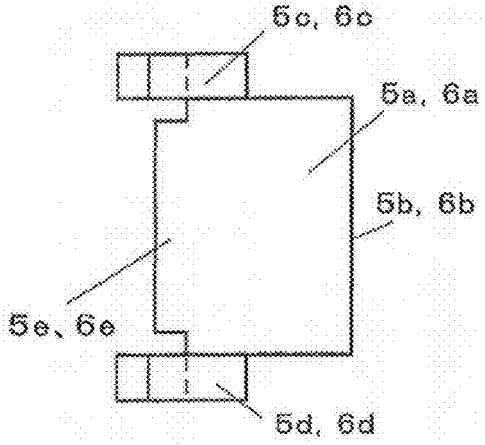

FIG. 10(*a*) and FIG. 10(*b*) include a plan view and a front view illustrating a modification of the first vane 5 and the second vane 6 of the vane compressor 200 according to Embodiment 2 of the present invention.

As illustrated in FIG. 10(*a*) and FIG. 10(*b*), the vane portion 5*a* of the first vane 5 and the vane portion 6*a* of the second vane 6 include respective vane inward projections 5*e* and 6*e* each projecting from a part of an end facet of the vane portion 5*a* or 6*a* that is close to the inner circumferential surface center toward the inner circumferential surface center with respect to the inner sides of the vane aligner portions 5*c* and 5*d* or the vane aligner portions 6*c* and 6*d*. In such a configuration, even if the end of each of the vane portions 5*a* and 6*a* that is close to the inner circumferential surface center does not project toward the inner side with respect to the bush center 7*a* or 8*a* during the rotation of the rotor portion 4*a*, the vane inward projection 5*e* or 6*e* is always positioned on the inner side with respect to the bush center 7*a* or 8*a*. Hence, the bushes 7 and 8 are allowed to stably rotate about the respective bush centers 7*a* and 8*a* and to always stably support the respective vane portions 5*a* and 6*a*, producing substantially the same effects as in the case illustrated in FIG. 9.

Advantageous Effects of Embodiment 2

In the above configuration, the outer size of the rotor portion 4*a* can be made smaller than in Embodiment 1, realizing a reduction in the size of the vane compressor 200.

Embodiment 3

A vane compressor 200 according to Embodiment 3 will now be described, focusing on differences from the vane compressor 200 according to Embodiment 1.

Configuration of Vane Compressor 200

Figure 11:
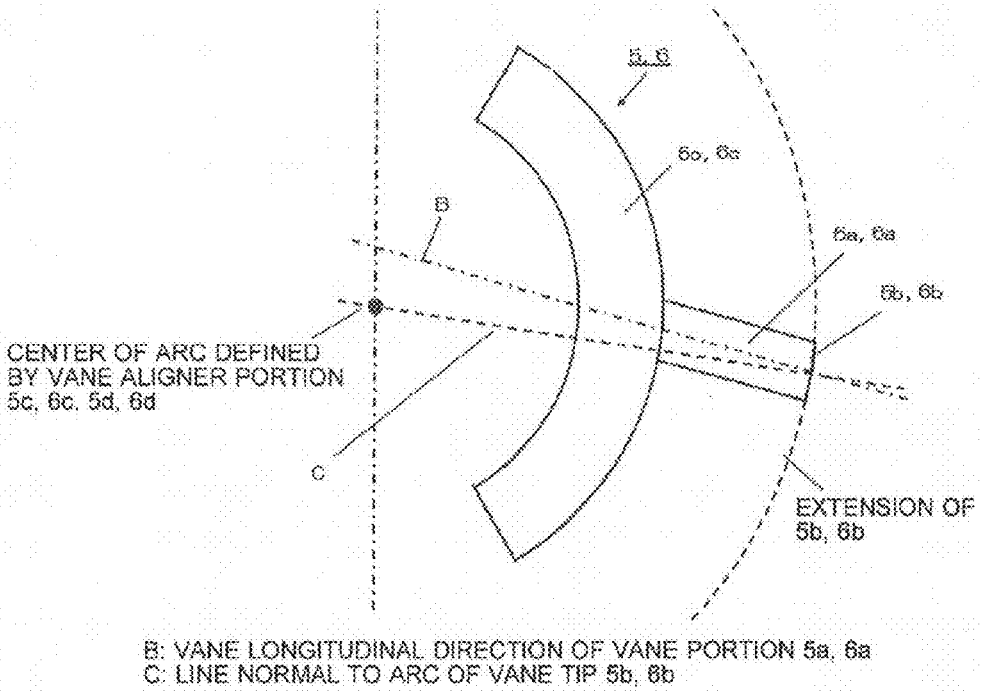
FIG. 11 is a plan view illustrating a first vane 5 or a second vane 6 of a vane compressor 200 according to Embodiment 3 of the present invention.
Figure 12:
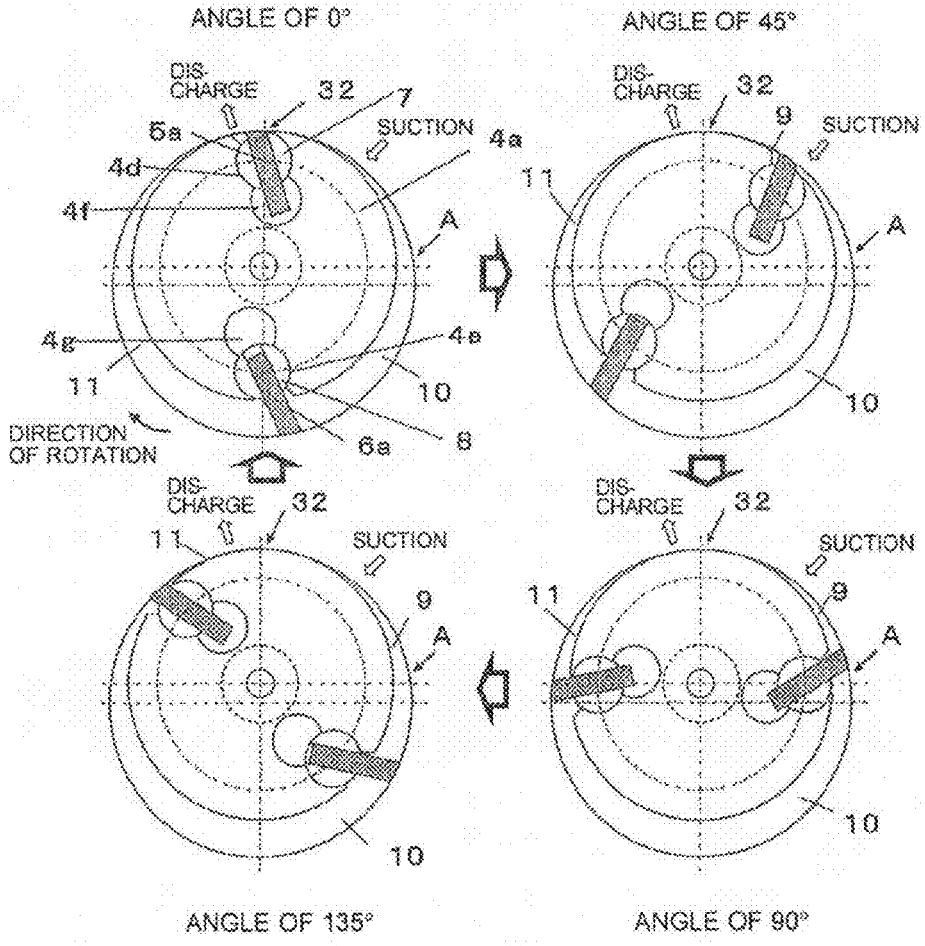
FIG. 12 includes diagrams illustrating a compressing operation performed by the vane compressor 200 according to Embodiment 3 of the present invention.

FIG. 11 is a plan view illustrating a first vane 5 or a second vane 6 of the vane compressor 200 according to Embodiment 3 of the present invention. FIG. 12 includes diagrams illustrating a compressing operation performed by the vane compressor 200.

As illustrated in FIG. 11, reference character B denotes a line extending in the longitudinal direction of a vane portion 5*a* or 6*a*, and reference character C denotes a line normal to the arc at a vane tip 5*b* or 6*b*. That is, the vane portion 5*a* or 6*a* is at an angle with respect to the vane aligner portions 5*c* and 5*d* or 6*c* and 6*d* in such a manner as to extend in the direction B. Furthermore, the line C normal to the arc at the vane tip 5*b* or 6*b* is at an angle with respect to the line B and passes through the center of the arc defined by the vane aligner portions 5*c* and 5*d* or 6*c* and 6*d*.

Furthermore, in Embodiment 3, the centers of the rotor portion 4*a* and the bush holding portions 4*d* and 4*e* are aligned on a substantially straight line. As illustrated in the diagram included in FIG. 12 illustrating "the angle of 0 degrees", the vane relief portion 4*f* is provided slightly on the right side with respect to the straight line, whereas the vane relief portion 4*g* is provided slightly on the left side with respect to the straight line.

Compressing Operation of Vane Compressor 200

In the above configuration also, a compressing operation is performed in a state where the line normal to the arc at each of the vane tips 5*b* and 6*b* and the line normal to the cylinder inner circumferential surface 1*b* always substantially coincide with each other, as in Embodiment 1 illustrated in FIG. 5. Hence, a very small gap is always provided between the cylinder inner circumferential surface 1*b* and each of the vane tips 5*b* and 6*b*, allowing the non-contact rotation of the vane tips 5*b* and 6*b*. Furthermore, at "the angle of 0 degrees" illustrated in FIG. 12, the end of the vane portion 6*a* of the second vane 6 that is close to the inner circumferential surface center projects toward the inner side with respect to the bush center 8*a* in the bush 8 as in Embodiment 1, allowing the bush 8 to stably rotate about the bush center 8*a*, whereby the vane is always stably supported.

Advantageous Effects of Embodiment 3

In Embodiment 3 also, a compressing operation is performed in a state where the line normal to the arc at each of the vane tips 5*b* and 6*b* and the line normal to the cylinder inner circumferential surface 1*b* always substantially coincide with each other, producing substantially the same effects as in Embodiment 1.

Embodiment 4

A vane compressor 200 according to Embodiment 4 will now be described, focusing on differences from the vane compressor 200 according to Embodiment 2.

Configuration of Vane Compressor 200

Figure 13:
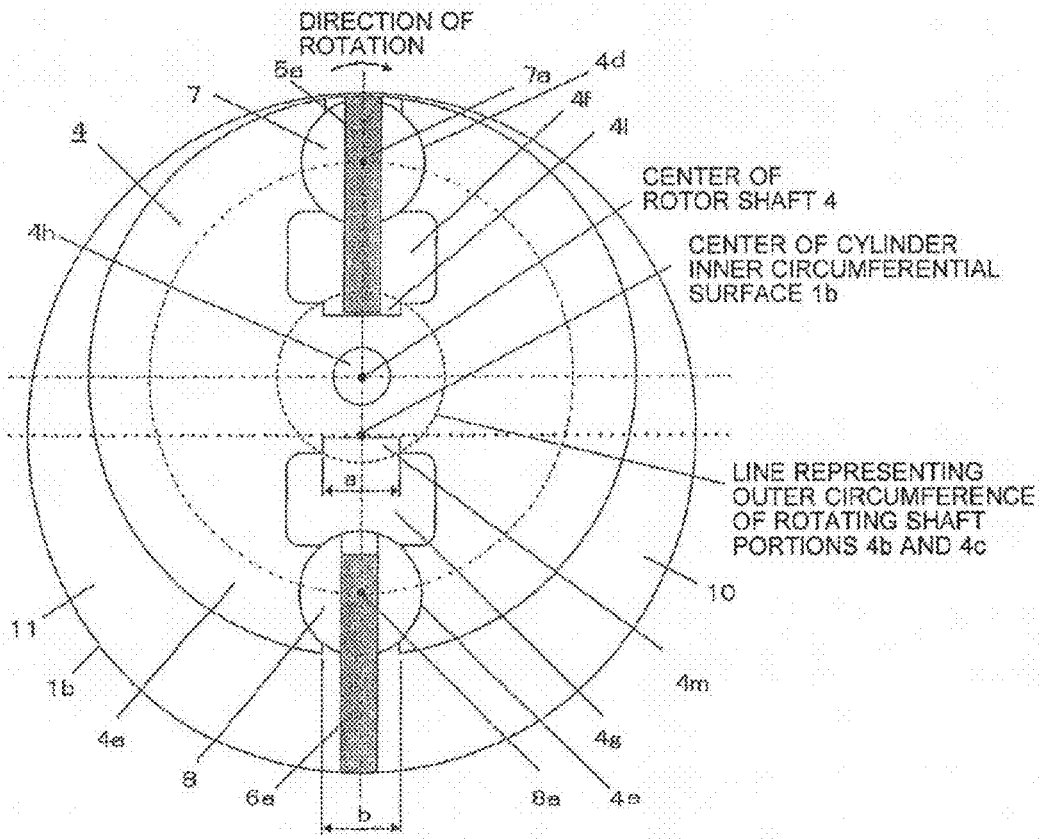
FIG. 13 is a sectional view of a vane compressor 200 according to Embodiment 4 of the present invention that is taken along line I-I illustrated in FIG. 1 and at "the angle of 0 degrees".

FIG. 13 is a sectional view of the vane compressor 200 according to Embodiment 4 of the present invention that is taken along line I-I illustrated in FIG. 1 and at "the angle of 0 degrees". In FIG. 13, the suction port 1*a*, the notch 1*c*, and the discharge port 1*d* are not illustrated.

As illustrated in FIG. 13, the end of each of the vane portion 5*a* of the first vane 5 and the vane portion 6*a* of the second vane 6 that is close to the inner circumferential surface center extends toward the inner side. Furthermore, the rotor portion 4*a* is configured such that, at "the angle of 0 degrees", the end of the vane portion 5*a* or 6*a* that is close to the inner circumferential surface center projects toward the inner side with respect to a line defined by the outer circumferences of the rotating shaft portions 4*b* and 4*c* (toward the center of the rotor shaft 4) in the rotor portion 4*a*. Correspondingly, second vane relief portions 41 and 4*m* extend from the respective vane relief portions 4*f* and 4*g* toward the center of the rotor portion 4*a*. The second vane relief portions 41 and 4*m* reside on the inner side with respect to the line defined by the outer circumferences of the rotating shaft portions 4*b* and 4*c*. Sections of the second vane relief portions 41 and 4*m* taken vertically to the central axis of the rotor portion 4*a* each have a rectangular shape. A circumferential-direction width a denotes the width of each of the second vane relief portions 41 and 4*m* that are seen in a direction of the central axis of the rotor portion 4*a*, and a circumferential-direction smallest width b denotes the width of each of openings provided in the side face of the rotor portion 4*a* at the bush holding portions 4*d* and 4*e* that are seen in the direction of the central axis of the rotor shaft 4. The circumferential-direction width a is substantially the same as the circumferential-direction smallest width b.

Figure 14:
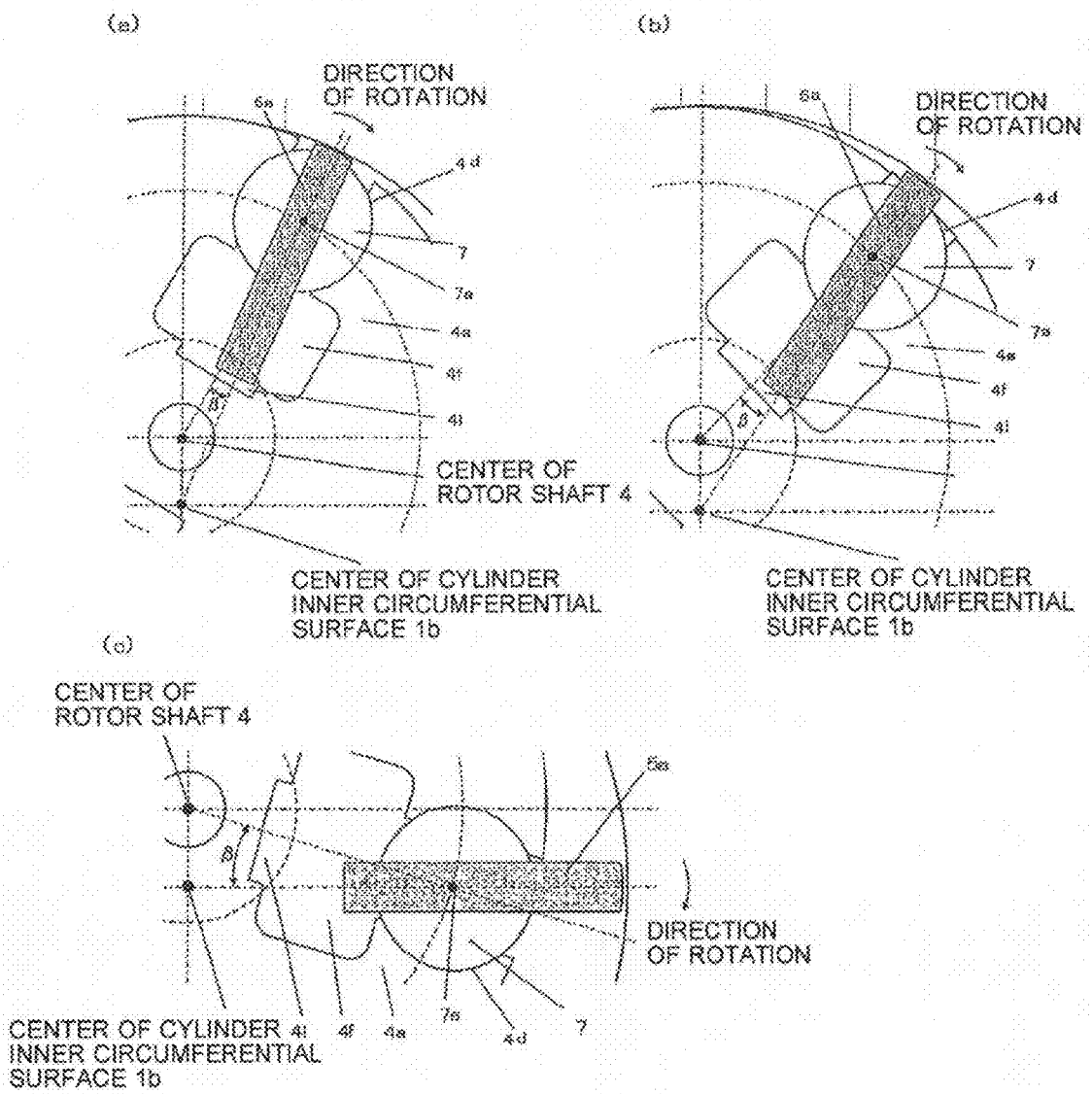
FIG. 14(*a*) to FIG. 14(*c*) include sectional views illustrating the vane portion 5*a* of the first vane 5 and associated elements included in the vane compressor 200 according to Embodiment 4 of the present invention at different angles of rotation established after the state illustrated in FIG. 13.

FIG. 14(*a*) to FIG. 14(*c*) include sectional views illustrating the vane portion 5*a* of the first vane 5 and associated elements included in the vane compressor 200 according to Embodiment 4 of the present invention at different angles of rotation established after the state illustrated in FIG. 13.

An angle β illustrated in FIG. 14(*a*) to FIG. 14(*c*) is an angle formed between a line connecting the center of the rotor portion 4*a* and the bush center 7*a* and the longitudinal direction of the vane portion 5*a* of the first vane 5 toward the center of the cylinder inner circumferential surface 1*b*.

FIG. 14(*a*) illustrates a state where the rotor portion 4*a* has rotated slightly from the state at "the angle of 0 degrees" illustrated in FIG. 13. The angle β gradually increases with the rotation of the rotor portion 4*a*. FIG. 14(*b*) illustrates a state where the rotor portion 4*a* has rotated further from the state illustrated in FIG. 14(*a*). The end of the vane portion 5*a* that is close to the inner circumferential surface center comes close to a side face of the second vane relief portion 4*l* (a face substantially parallel to the line connecting the center of the rotor shaft 4 and the bush center 7*a*) but moves away from the bottom face of the second vane relief portion 4*l* (a face substantially perpendicular to the line connecting the center of the rotor shaft 4 and the bush center 7*a*). In this state, the angle β has increased further, and a corner of the vane portion 5*a* at the end close to the inner circumferential surface center and on a leading side in the direction of rotation has gone out of the second vane relief portion 4*l* and has moved into the vane relief portion 4*f*. As illustrated in FIG. 14, the circumferential-direction width of the vane relief portion 4*f* (the width of the vane relief portion 4*f* that is seen in the direction of the central axis of the rotor portion 4*a*) is much larger than the circumferential-direction width a of the second vane relief portion 4*l*. Hence, there is no chance of the vane portion 5*a* coming into contact with the rotor portion 4*a*. FIG. 14(*c*) illustrates a state where the angle of rotation of the rotor portion 4*a* has increased further from "the angle of 90 degrees", and the angle formed between the longitudinal direction of the vane portion 5*a* and the line connecting the center of the rotor shaft 4 and the center of the cylinder inner circumferential surface 1*b* is 90 degrees. In this state, the angle β is largest. In this state, the end of the vane portion 5*a* that is close to the inner circumferential surface center is positioned in the vane relief portion 4*f* and is therefore out of contact with the rotor portion 4*a*.

The behavior of the vane portion 5*a* of the first vane 5 illustrated in FIG. 14 also applies to the case of the vane portion 6*a* of the second vane 6.

Figure 15:
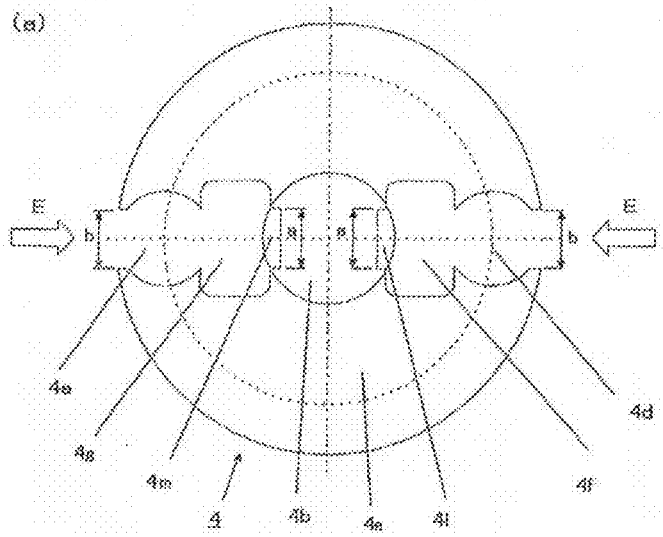
FIG. 15(*a*) and FIG. 15(*b*) include a plan view and a vertical sectional view of a rotor shaft 4 included in the vane compressor 200 according to Embodiment 4 of the present invention.
Figure 15:
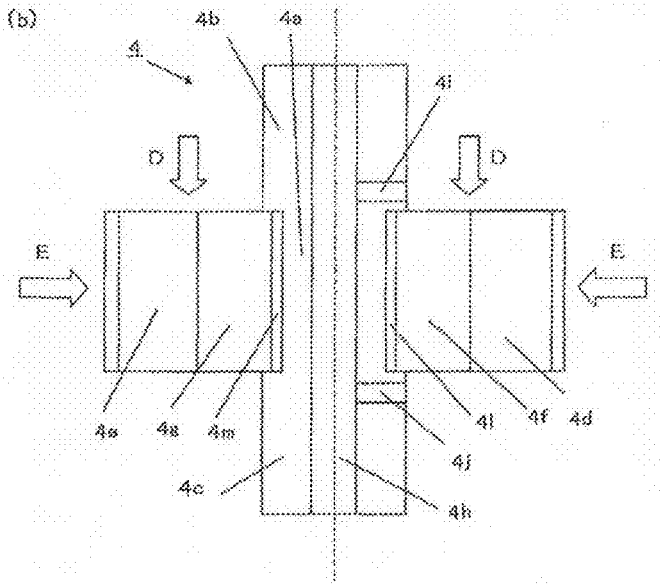

FIG. 15(*a*) and FIG. 15(*b*) include a plan view and a vertical sectional view of the rotor shaft 4 included in the vane compressor 200 according to Embodiment 4 of the present invention. FIG. 15(*a*) is the plan view of the rotor shaft 4. FIG. 15(*b*) is the vertical sectional view of the rotor shaft 4.

The bush holding portions 4*d* and 4*e* and the vane relief portions 4*f* and 4*g* are processed in the direction of the central axis of the rotor shaft 4 as represented by arrows D in FIG. 15. In contrast, the second vane relief portions 4*l* and 4*m* are processed from the side face of the rotor portion 4*a* as represented by arrows E in FIG. 15 because the second vane relief portions 4*l* and 4*m* extend from the respective vane relief portions 4*f* and 4*g* toward the central axis of the rotor portion 4*a* and are provided on the inner side with respect to the line defined by the outer circumferences of the rotating shaft portions 4*b* and 4*c*. In Embodiment 4, since the circumferential-direction width a of each of the second vane relief portions 4*l* and 4*m* substantially coincides with the circumferential-direction smallest width b of each of the bush holding portions 4*d* and 4*e*, the second vane relief portions 4*l* and 4*m* are easy to process.

As long as the end of each of the vane portions 5*a* and 6*a* that is close to the inner circumferential surface center is kept out of contact with the side face of a corresponding one of the second vane relief portions 4*l* and 4*m*, the circumferential-direction width a of the second vane relief portions 4*l* and 4*m* may be smaller than the circumferential-direction smallest width b of the bush holding portions 4*d* and 4*e*.

Advantageous Effects of Embodiment 4

In the rotor portion 4*a* configured as above, if the second vane relief portions 4*l* and 4*m* are provided in such a manner as to allow the vane portions 5*a* and 6*a* to rotate without coming into contact with the rotor portion 4*a* even in a case where the end of each of the vane portions 5*a* and 6*a* that is close to the inner circumferential surface center projects toward the inner side with respect to the line corresponding to the diameters of the rotating shaft portions 4*b* and 4*c*, the end of each of the vane portions 5*a* and 6*a* that is close to the inner circumferential surface center can be made to extend further toward the inner circumferential surface center. Hence, the outer size of the rotor portion 4*a* can be made smaller than in Embodiment 1, realizing a reduction in the size of the vane compressor 200.

Furthermore, since the circumferential-direction width a of the second vane relief portions 4*l* and 4*m* is substantially the same as or smaller than the circumferential-direction smallest width b of the bush holding portions 4*d* and 4*e*, the second vane relief portions 4*l* and 4*m* are easy to process.

Figure 16:
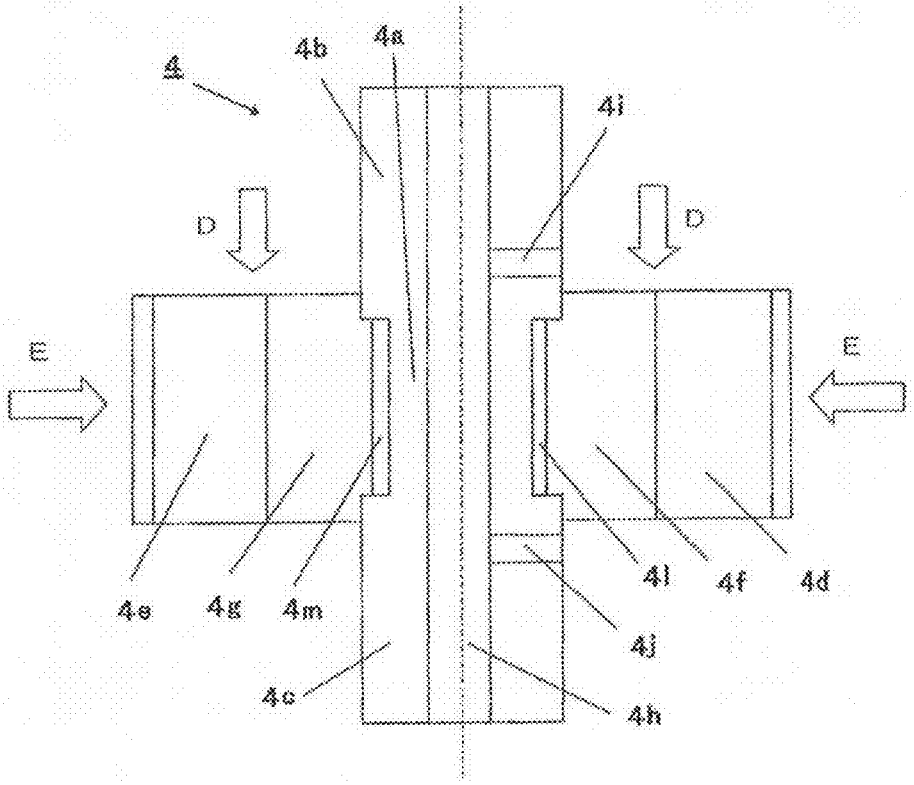
FIG. 16 is a vertical sectional view illustrating a modification of the rotor shaft 4 included in the vane compressor 200 according to Embodiment 4 of the present invention.

While the second vane relief portions 4*l* and 4*m* provided in the rotor shaft 4 illustrated in FIG. 15 extend over the entirety of the rotor portion 4*a* in the axial direction of the rotor portion 4*a*, the present invention is not limited to such a case. That is, in a modification, illustrated in FIG. 16, of the rotor shaft 4 included in the vane compressor 200 according to Embodiment 4, the length of the second vane relief portions 4*l* and 4*m* in the axial direction may be smaller than the length of the rotor portion 4*a* in the axial direction (the second vane relief portions 4*l* and 4*m* illustrated in FIG. 16 each extend over a region of the rotor portion 4*a* excluding regions at two axial ends of the rotor portion 4*a*). In such a case, the first vane 5 and the second vane 6 according to Embodiment 2 illustrated in FIG. 10 may be employed. If so, an end facet of the vane inward projection 5*e* of the vane portion 5*a* that is close to the inner circumferential surface center is positioned in the second vane relief portion 4*l*, and an end facet of the vane inward projection 6*e* of the vane portion 6*a* that is close to the inner circumferential surface center is positioned in the second vane relief portion 4*m*.

In such a configuration, since the second vane relief portions 4*l* and 4*m* are not necessarily extend over the entirety of the rotor portion 4*a* in the axial direction, the rigidity of the shaft is increased without reducing the areas of contact between the rotor portion 4*a* and the rotating shaft portion 4*b* and between the rotor portion 4*a* and the rotating shaft portion 4*c*. Hence, a highly reliable vane compressor 200 exhibiting higher axial strength and smaller axial warpage than those provided by the rotor shaft 4 illustrated in FIG. 15 is provided.

While Embodiments 1 to 4 each concern a case where the oil pump 31 utilizing the centrifugal force of the rotor shaft 4 is employed, the oil pump 31 may be of any type. For example, a positive-offset pump disclosed by Japanese Unexamined Patent Application Publication No. 2009-62820 may be employed as the oil pump 31.

REFERENCE SIGNS LIST

1 cylinder 1*a* suction port 1*b* cylinder inner circumferential surface 1*c* notch 1*d* discharge port 1*e* oil return hole 1*f* through portion

2 frame 2*a* recess 2*b* vane aligner bearing portion 2*c* main bearing portion 2*d* discharge port 3 cylinder head 3*a* recess 3*b* vane aligner bearing portion 3*c* main bearing portion

4 rotor shaft 4*a* rotor portion 4*b*, 4*c* rotating shaft portion 4*d*,

4*e* bush holding portion 4*f*, 4*g* vane relief portion 4*h* to 4*j* oil supply path 4*k* oil discharge hole 4*l*, 4*m* second vane relief portion 5 first vane 5*a* vane portion 5*b* vane tip 5*c*, 5*d* vane aligner portion 5*e*, 6*e* vane inward projection 6 second vane 6*a* vane portion 6*b* vane tip 6*c*,

6*d* vane aligner portion 7 bush 7*a* bush center 8 bush 8*a* bush center 9 suction chamber 10 intermediate chamber 11 compression chamber 21 stator 22 rotor 23 glass terminal 24 discharge pipe 25 refrigerating machine oil 26 suction pipe 27 discharge valve 28 discharge valve stopper 31 oil pump 32 nearest point 41 to 43 arrow 44, 45 moment 101 compressing element 102 motor element 103 closed container 104 oil reservoir 200 vane compressor

The invention claimed is:

1. A vane compressor comprising:

a compressing element that compresses a refrigerant, the compressing element including a cylinder having a cylindrical inner circumferential surface;

a rotor shaft including a cylindrical rotor portion and a rotating shaft portion in the cylinder, the rotor portion being configured to rotate about an axis of rotation offset from a central axis of the inner circumferential surface of the cylinder by a predetermined distance, the rotating shaft portion being configured to transmit a rotational force from an outside to the rotor portion;

a frame that closes one of openings defined by the inner circumferential surface of the cylinder and supports the rotating shaft portion by a main bearing portion;

a cylinder head that closes the other of the openings defined by the inner circumferential surface of the cylinder and supports the rotating shaft portion by a main bearing portion; and at least one vane provided to the rotor portion and whose tip projects from the rotor portion and is shaped as an arc that is convex outward, wherein the vane compressor further comprises a vane supporter that supports the vane such that the refrigerant is compressed in a space defined by the vane, an outer circumference of the rotor portion, and the inner circumferential surface of the cylinder and such that a line normal to the are at the tip of the vane and a line normal to the inner circumferential surface of the cylinder coincide with each other, the vane supporter supporting the vane such that the vane is rotatable, and movable in a centrifugal direction with respect to the rotor portion, the vane supporter holding the vane such that a predetermined gap is provided between the tip of the vane and the inner circumferential surface of the cylinder in a state where the tip has moved by a maximum length toward the inner circumferential surface of the cylinder, wherein the vane supporter includes a bush holding portion provided closely to the outer circumference of the rotor portion and extending through the vane supporter in a direction of a central axis of the rotor portion, the bush holding portion having a circular cross-section that is taken perpendicularly to the central axis;

a bush including a pair of members each having a semicircular columnar shape, the members being fitted in the bush holding portion and holding the vane there between in the bush holding portion; and a first vane relief portion extending through the rotor portion in the direction of the central axis of the rotor portion such that an end facet of the vane that is close to an inner circumferential surface center is kept out of contact with the rotor portion, wherein the vane includes a pair of vane aligner portions each shaped as a part of a ring, one of the vane aligner portions being provided closely to a part of the end facet of the vane that is on a side close to the frame and that is close to the center of the rotor portion, the other vane aligner portion being provided closely to a part of the end facet of the vane that is on a side close to the cylinder head and that is close to the center of the rotor portion, wherein the frame and the cylinder head each have a recess or a groove provided in the end facet that is close to the cylinder, the recess or the groove being concentric with respect to the inner circumferential surface of the cylinder, and wherein the vane aligner portions are fitted in the recess or the groove and are supported by a vane aligner bearing portion provided as an outer circumferential surface of the recess or the groove, wherein the rotor shaft is an integral body including the rotor portion and the rotating shaft portion, and wherein the end facet of the vane that is close to the inner circumferential surface center, which is the center of the inner circumferential surface of the cylinder, is always positioned more inside the rotor portion than a center of rotation of the vane that is rotatable with respect to the rotor portion.

2. The vane compressor of claim 1, wherein, at an angle of rotation of the rotor portion at which a distance between the center of rotation, with respect to the rotor portion, of the vane and the end facet of the vane that is close to the inner circumferential surface center is smallest, the end of the vane that is close to the inner circumferential surface center is prevented from being positioned more inside the rotor portion than an end of the bush that is close to the inner circumferential surface center.

3. The vane compressor of claim 1, wherein at least a part of the end facet of the vane that is close to the inner circumferential surface center is positioned closer to the inner circumferential surface center than inner sides of the vane aligner portions.

4. The vane compressor of claim 3, wherein the rotor portion includes a second vane relief portion provided in a part that is on an inner side with respect to a line defined by the outer circumference of the rotating shaft portion, the part being at a position of the rotor portion that corresponds to a side of the vane that is close to the inner circumferential surface center, the second vane relief portion communicating with the first vane relief portion, and wherein, when the end facet of the vane that is close to the inner circumferential surface center is positioned more inside than the line defined in the rotor portion by the outer circumference of the rotating shaft portion, the end facet of the vane is positioned in the second vane relief portion.

5. The vane compressor of claim 4, wherein, in a view in which the rotor portion is seen in the direction of the central axis, a width of the second vane relief portion is the same as or smaller than a width of an opening provided on a side of the bush holding portion that is close to a side surface of the rotor portion.

6. The vane compressor of claim 4, wherein a part of the end facet of the vane that is close to the inner circumferential surface center is positioned on a side closer to the inner circumferential surface center than the inner sides of the respective vane aligner portions, and wherein a length of the second vane relief portion in the direction of the central axis of the rotor portion is smaller than a length of the rotor portion in the direction of the central axis of the rotor portion.

7. The vane compressor of claim 1, wherein a radius of curvature of the arc at the tip of the vane is the same as a radius of curvature of the inner circumferential surface of the cylinder.

* * * * *